US010760812B2

(12) United States Patent
Komatsu et al.

(10) Patent No.: US 10,760,812 B2
(45) Date of Patent: Sep. 1, 2020

(54) INDOOR UNIT FOR AIR CONDITIONING DEVICE

(71) Applicant: DAIKIN INDUSTRIES, LTD., Osaka-shi, Osaka (JP)

(72) Inventors: Akira Komatsu, Osaka (JP); Nobuyuki Kojima, Osaka (JP); Takahiro Wasaka, Osaka (JP); Masaaki Murata, Osaka (JP)

(73) Assignee: DAIKIN INDUSTRIES, LTD., Osaka-Shi (JP)

( * ) Notice: Subject to any disclaimer, the term of this patent is extended or adjusted under 35 U.S.C. 154(b) by 14 days.

(21) Appl. No.: 15/512,438

(22) PCT Filed: Sep. 30, 2015

(86) PCT No.: PCT/JP2015/004965
§ 371 (c)(1),
(2) Date: Mar. 17, 2017

(87) PCT Pub. No.: WO2016/051789
PCT Pub. Date: Apr. 7, 2016

(65) Prior Publication Data

US 2017/0276392 A1 Sep. 28, 2017

(30) Foreign Application Priority Data

Sep. 30, 2014 (JP) ..... 2014-201168

(51) Int. Cl.
*F24F 11/76* (2018.01)
*F24F 11/89* (2018.01)
(Continued)

(52) U.S. Cl.
CPC ..... *F24F 11/76* (2018.01); *F24F 1/0014* (2013.01); *F24F 1/0022* (2013.01);
(Continued)

(58) Field of Classification Search
CPC ..... F24F 1/0022; F24F 11/76; F24F 13/1413
(Continued)

(56) References Cited

U.S. PATENT DOCUMENTS

2012/0214398 A1* 8/2012 Nouchi ..... F24F 1/0014 454/256
2012/0288363 A1* 11/2012 Yumoto ..... F24F 1/0014 415/182.1

FOREIGN PATENT DOCUMENTS

CN 102575869 A 7/2012
EP 2484986 A1 8/2012
(Continued)

*Primary Examiner* — Steven B McAllister
*Assistant Examiner* — Allen R Schult
(74) *Attorney, Agent, or Firm* — Birch, Stewart, Kolasch & Birch, LLP

(57) ABSTRACT

In order to carry out, in a heating operation, an airflow rate adjusting operation in which a reduced amount of conditioned air is blown in one or more of a plurality of blowing directions to increase a blowing speed in the rest of the blowing directions, an operation control section is configured to control the flow of the conditioned air such that the conditioned air is blown out in a horizontal blow mode in the blowing direction in which the blowing speed is increased by the airflow rate adjusting operation, and periodically change the blowing direction in which a reduced amount of the conditioned air is blown. As a result, temperature variations in the air-conditioning target space in the heating operation are reduced.

5 Claims, 17 Drawing Sheets

(51) Int. Cl.

| | |
|---|---|
| ***F24F 1/0014*** | (2019.01) |
| ***F24F 11/79*** | (2018.01) |
| ***F24F 1/0047*** | (2019.01) |
| ***F24F 1/0022*** | (2019.01) |
| ***F24F 13/14*** | (2006.01) |
| ***F24F 13/20*** | (2006.01) |

(52) U.S. Cl.
CPC ..... *F24F 1/0047* (2019.02); *F24F 11/79* (2018.01); *F24F 11/89* (2018.01); *F24F 13/1413* (2013.01); *F24F 13/20* (2013.01); *F24F 2221/54* (2013.01)

(58) Field of Classification Search
USPC ..... 454/229
See application file for complete search history.

(56) References Cited

FOREIGN PATENT DOCUMENTS

| | | | |
|---|---|---|---|
| EP | 2498018 | A1 | 9/2012 |
| EP | 2530395 | A1 | 12/2012 |
| JP | 4-28946 | A | 1/1992 |
| JP | 2002-98397 | A | 4/2002 |
| JP | 2011-185591 | A | 9/2011 |
| JP | 2012-184868 | A | 9/2012 |
| WO | WO 2011/099608 | A1 | 8/2011 |

* cited by examiner

INDOOR UNIT FOR AIR CONDITIONING DEVICE

TECHNICAL FIELD

The present invention relates to an indoor unit of an air conditioner, and in particular relates to a technique for controlling an airflow blown out from an indoor unit installed in a ceiling.

BACKGROUND ART

When it comes to air conditioners, these days great importance is placed on comfort in an indoor environment created by the airflow blown out from the indoor unit.

For example, Patent Document 1 discloses an air conditioning machine which includes an indoor unit having an upper outlet port opening upward and a lower outlet port opening downward. The indoor unit changes an airflow division ratio (i.e., a ratio between the air blown upward through the upper outlet port and the air blown downward through the lower outlet port) in a heating operation according to perimeter loads (i.e., loads near windows).

CITATION LIST

Patent Document

Patent Document 1: Japanese Unexamined Patent Publication No. H4-28946

SUMMARY OF THE INVENTION

Technical Problem

In general, air conditioners having an indoor unit installed in a ceiling control the airflow such that, for example, warm air is blown downward in a heating operation to warm an interior zone of a room and then supplied to a perimeter zone of the room. However, in such an airflow control, part of the warm air blown downward from the indoor unit goes up before reaching the perimeter zone, and only a reduced amount of the warm air reaches the perimeter zone. This phenomenon may produce temperature variations in the room.

In view of the foregoing background, it is therefore an object of the present invention to reduce temperature variations in the air-conditioning target space during a heating operation.

Solution to the Problem

To achieve the above objective, according to one or more aspects of the present disclosure, an operation control section (70) carries out, in a heating operation, an airflow rate adjusting operation, in which a reduced amount of conditioned air is blown in one or more of a plurality of blowing directions to increase the blowing speed in the rest of the blowing directions, by periodically changing the blowing direction in which a reduced amount of the conditioned air is blown.

A first aspect of the disclosure is directed to an indoor unit of an air conditioner having a casing (20) installed in a ceiling (U) of an air-conditioning target space (R). The casing (20) is provided with outlet ports (26) capable of blowing out conditioned air in a plurality of blowing directions different from one another. The indoor unit is provided with an operation control section (70) to carry out, in a heating operation, an airflow rate adjusting operation in which in which a reduced amount of the conditioned air is blown in one or more of the plurality of blowing directions to increase a blowing speed in the rest of the blowing directions. To carry out the airflow rate adjusting operation, the operation control section (70) is configured to control flow of the conditioned air such that the conditioned air is blown out in a horizontal blow mode in the blowing direction in which the blowing speed is increased by the airflow rate adjusting operation, and periodically change the blowing direction in which a reduced amount of the conditioned air is blown.

According to the first aspect, the casing (20) of the indoor unit installed in the ceiling (U) of the air-conditioning target space (R) is provided with the outlet ports (26) capable of blowing out conditioned air in a plurality of blowing directions different from one another. The operation control section (70) of the indoor unit carries out, in a heating operation, an airflow rate adjusting operation in which a reduced amount of the conditioned air is blown in one or more of the plurality of blowing directions to increase the blowing speed in the rest of the blowing directions. In this airflow rate adjusting operation, the blowing speed of the conditioned air is increased in the direction other than the direction in which a reduced amount of the conditioned air is blown. Thus, the conditioned air blown out from the outlet ports (26) with increased air blowing speed travels further into the room space (R), which means that the conditioned air reaches the perimeter zone of the room space (R) more easily. The operation control section (70) controls the flow of the conditioned air such that the conditioned air is blown out in the horizontal blow mode in the blowing direction in which the blowing speed is increased by the airflow rate adjusting operation. Thus, the conditioned air may be circulated through the air-conditioning target space (R) in which the conditioned air blown out from the outlet port (26) of the indoor unit installed in the ceiling (U) for example hits against a wall surface of the air-conditioning target space (R), flows sequentially along the wall surface and the floor surface, and is drawn into the indoor unit. Further, the operation control section (70) periodically changes the blowing direction in which a reduced amount of the conditioned air is blown, in carrying out the airflow rate adjusting operation. In other words, the blowing direction in which the conditioned air is blown with increased speed is also changed periodically. As a result, the conditioned air (i.e., warm air) blown out through the outlet ports (26) reaches the perimeter zone of the air-conditioning target space (R) more easily, which thus reduces the temperature variations in the air-conditioning target space (R) in the heating operation.

In general, the warm conditioned air being blown out in all the plurality of blowing directions in the heating operation may easily result in overheating the room. According to the first aspect described above, however, a reduced amount of the warm conditioned air is blown in one or more of the plurality of blowing directions, and the room may thus be prevented from being overheated. That is, the first aspect of the present disclosure may reduce temperature variations in the air-conditioning target space (R) in the heating operation, while reducing overheating of the room. In addition, the warm conditioned air easily reaches the perimeter zone of the air-conditioning target space (R) in the heating operation, which allows the warm conditioned air to smoothly circulate in the air-conditioning target space (R) and hence achieves quick heating of the air-conditioning target space (R).

A second aspect of the disclosure is an embodiment of the first aspect. In the second aspect, the indoor unit is configured to blow out the conditioned air in four blowing directions 90° apart from each other. The operation control section (70) reduces, in the airflow rate adjusting operation, flow of the conditioned air in two of the four blowing directions to increase the blowing speed in the other two blowing directions.

According to the second aspect, the indoor unit is configured to blow out the conditioned air in four different blowing directions 90° apart from each other. The operation control section (70) carries out the airflow rate adjusting operation in which a reduce amount of the conditioned air is blown in two of the four blowing directions to increase the blowing speed in the other two blowing directions. Thus, in this airflow rate adjusting operation, the blowing speed in the two blowing directions in which the conditioned air is blown out simultaneously is higher than in a case where the conditioned air is blown out simultaneously in all of the four blowing directions.

A third aspect of the disclosure is an embodiment of the first or second aspect. In the third aspect, the indoor unit includes a load detection section (71) which detects, for each of the blowing directions, whether an area of a perimeter zone of the air-conditioning target space (R) is a high load area having a relatively large air conditioning load or a low load area having a smaller air conditioning load than the high load area. The operation control section (70) carries out the airflow rate adjusting operation such that an accumulated value of flow rates of air into the high load area in a predetermined reference time is greater than an accumulated value of flow rates of air into the low load area in the predetermined reference time, by periodically changing the blowing direction in which a reduced amount of the conditioned air is blown.

According to the third aspect, the load detection section (71) of the indoor unit detects, for each of the blowing directions of the conditioned air, whether an area of the perimeter zone of the air-conditioning target space (R) is a high load area having a relatively large air conditioning load or a low load area having a smaller air conditioning load than the high load area. Further, the operation control section (70) changes periodically, in carrying out the airflow rate adjusting operation, the blowing direction in which a reduced amount of the conditioned air is blown, such that an accumulated value of flow rates of air into the high load area in a predetermined reference time is greater than an accumulated value of flow rates of air into the low load area in the predetermined reference time. As a result, the flow rate of air into the high load area of the air-conditioning target space (R) is increased and the flow rate of air into the low load area is reduced, which allows for further reducing the temperature variations in the air-conditioning target space (R).

A fourth aspect of the disclosure is an embodiment of any one of the first to third aspects. In the fourth aspect, the outlet ports (26) include a plurality of primary outlet ports (24) configured to blow out the conditioned air in directions different from one another. The casing (20) is provided with an intake hole (23) arranged adjacent to the plurality of primary outlet ports (24) and configured to draw in room air. The operation control section (70) controls the flow of the conditioned air blown out from the primary outlet port (24) corresponding to the blowing direction in which a reduced amount of the conditioned air is blown in the airflow rate adjusting operation, such that the conditioned air is blown out toward the intake hole (23) and drawn into the intake hole (23).

According to the fourth aspect, the outlet ports (26) include a plurality of primary outlet ports (24) configured to blow out the conditioned air in directions different from one another, and the casing (20) of the indoor unit is provided with the intake hole (23) arranged adjacent to the plurality of primary outlet ports (24) and configured to draw in room air. Further, the operation control section (70) controls the flow of the conditioned air blown out from the primary outlet port (24) corresponding to the blowing direction in which a reduced amount of the conditioned air is blown in the airflow rate adjusting operation, such that the conditioned air is blown out toward the intake hole (23) and drawn into the intake hole (23). Thus, the conditioned air blown out through the primary outlet port (24) corresponding to the blowing direction in which a reduced amount of the conditioned air is blown, is not blown into the air-conditioning target space (R) but is directly drawn into the intake hole (23) adjacent to the primary outlet port (24). That is, a short-circuit of the airflow may be generated.

A fifth aspect of the disclosure is an embodiment of the second aspect. In the fifth aspect, the two blowing directions in which a reduced amount of the conditioned air is blown are 180° apart from each other.

According to the fifth aspect, the two blowing directions in which a reduced amount of the conditioned air is blown are 180° apart from each other. Thus, the conditioned air is blown out from the outlet ports (26) with an increased blowing speed due to the airflow rate adjusting operation in the directions 180° apart from each other.

Advantages of the Invention

According to one or more embodiments of the present disclosure, the operation control section (70) carries out, in a heating operation, an airflow rate adjusting operation, in which a reduced amount of conditioned air is blown in one or more of a plurality of blowing directions to increase the blowing speed in the rest of the blowing directions, by periodically changing the blowing direction in which a reduced amount of the conditioned air is blown. As a result, the temperature variations in the air-conditioning target space (R) in the heating operation may be reduced.

DESCRIPTION OF EMBODIMENTS

Embodiments of the present invention will be described in detail below, based on the drawings.

Figure 1:
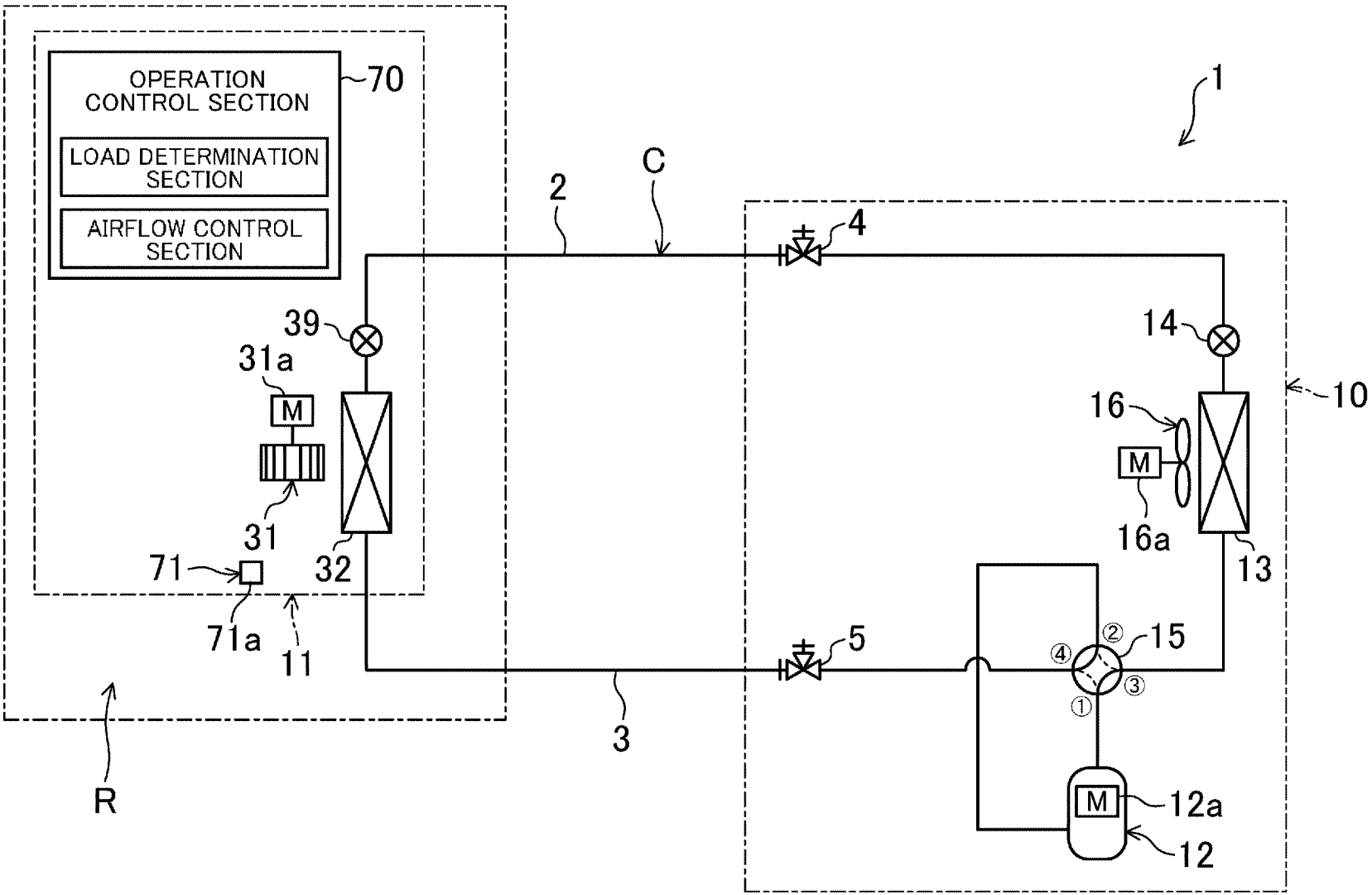
FIG. 1 is a diagram illustrating a refrigerant circuit of an air conditioner according to an embodiment.

The present embodiment relates to an air conditioner (1) which cools and heats a room. As illustrated in FIG. 1, the air conditioner (1) includes an outdoor unit (10) installed outside the room and an indoor unit (11) installed inside the room. The outdoor unit (10) and the indoor unit (11) are connected to each other with two connection pipes (2, 3). Thus, a refrigerant circuit (C) is formed in the air conditioner (1). The refrigerant circuit (C) is filled with a refrigerant which is circulated to perform a vapor compression refrigeration cycle.

<Configuration of Refrigerant Circuit>

The outdoor unit (10) is provided with a compressor (12), an outdoor heat exchanger (13), an outdoor expansion valve (14), and a four-way switching valve (15). The compressor (12) compresses low-pressure refrigerant and discharges compressed, high-pressure refrigerant. In the compressor (12), a compression mechanism (e.g., scroll or rotary compressor) is actuated by a compressor motor (12*a*). Due to an invertor device, the number of rotations (i.e., the drive frequency) of the compressor motor (12*a*) is adjustable.

The outdoor heat exchanger (13) is a fin-and-tube heat exchanger. An outdoor fan (16) is provided near the outdoor heat exchanger (13). The outdoor heat exchanger (13) exchanges heat between the air transferred by the outdoor fan (16) and the refrigerant. The outdoor fan (16) is configured as a propeller fan actuated by an outdoor fan motor (16*a*). Due to an invertor device, the number of rotations of the outdoor fan motor (16*a*) is adjustable.

The outdoor expansion valve (14) is configured as an electronic expansion valve, the opening degree of which is variable. The four-way switching valve (15) has first to fourth ports. In the four-way switching valve (15), the first port is connected to the discharge side of the compressor (12); the second port is connected to the intake side of the compressor (12); the third port is connected to a gas-side end portion of the outdoor heat exchanger (13); and the fourth port is connected to a gas-side shut-off valve (5). The four-way switching valve (15) is switchable between a first state (i.e., the state indicated by the solid line in FIG. 1) and a second state (i.e., the state indicated by the broken line in FIG. 1). In the four-way switching valve (15) in the first state, the first port communicates with the third port, and the second port communicates with the fourth port. In the four-way switching valve (15) in the second state, the first port communicates with the fourth port, and the second port communicates with the third port.

The two connection pipes (2, 3) are configured as a fluid-carrying pipe (2) and a gas-carrying pipe (3). One end of the liquid-carrying pipe (2) is connected to a liquid-side shut-off valve (4), and the other end is connected to a liquid-side end portion of an indoor heat exchanger (32). One end of the gas-carrying pipe (3) is connected to the gas-side shut-off valve (5), and the other end is connected to a gas-side end portion of the indoor heat exchanger (32).

The indoor unit (11) is provided with the indoor heat exchanger (32) and an indoor expansion valve (39). The indoor heat exchanger (32) is a fin-and-tube heat exchanger. An indoor fan (31) is provided near the indoor heat exchanger (32). As will be described later, the indoor fan (31) is a centrifugal fan actuated by an indoor fan motor (31*a*). Due to an invertor device, the number of rotations of the indoor fan motor (31*a*) is adjustable. The indoor expansion valve (39) is connected to a liquid-side end portion of the indoor heat exchanger (32) in the refrigerant circuit (C). The indoor expansion valve (39) is configured as an electronic expansion valve, the opening degree of which is variable.

[Indoor Unit]

FIGS. 2-5 illustrate example configurations of the indoor unit (11). The indoor unit (11) is connected to the outdoor unit (10) placed outside a room space (R), i.e., an air-conditioning target space, via the connection pipes (2, 3). The indoor unit (11) and the outdoor unit (10) together form the air conditioner (1). The air conditioner (1) is configured to cool and heat the room space (R). In this example, the indoor unit (11) is an indoor unit installed in a ceiling. The indoor unit (11) includes an indoor casing (20), the indoor fan (31), the indoor heat exchanger (32), a drain pan (33), and a bell mouth (34). The indoor casing (20) is installed in a ceiling (U) of the room space (R). The indoor casing (20) is configured as a casing body (21) and a decorative panel (22).

Figure 2:
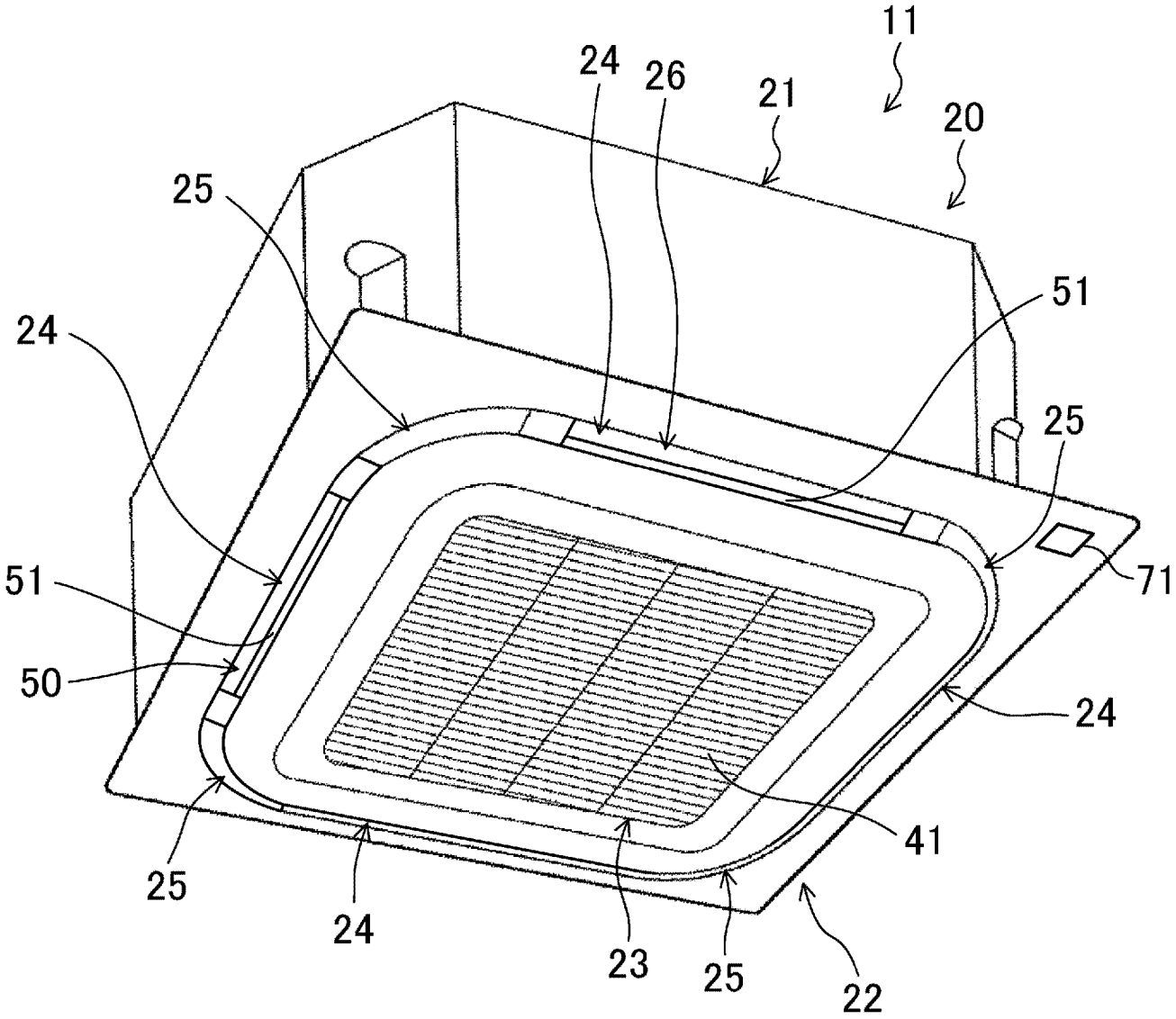
FIG. 2 is a perspective view of an indoor unit of the air conditioner shown in FIG.
Figure 3:
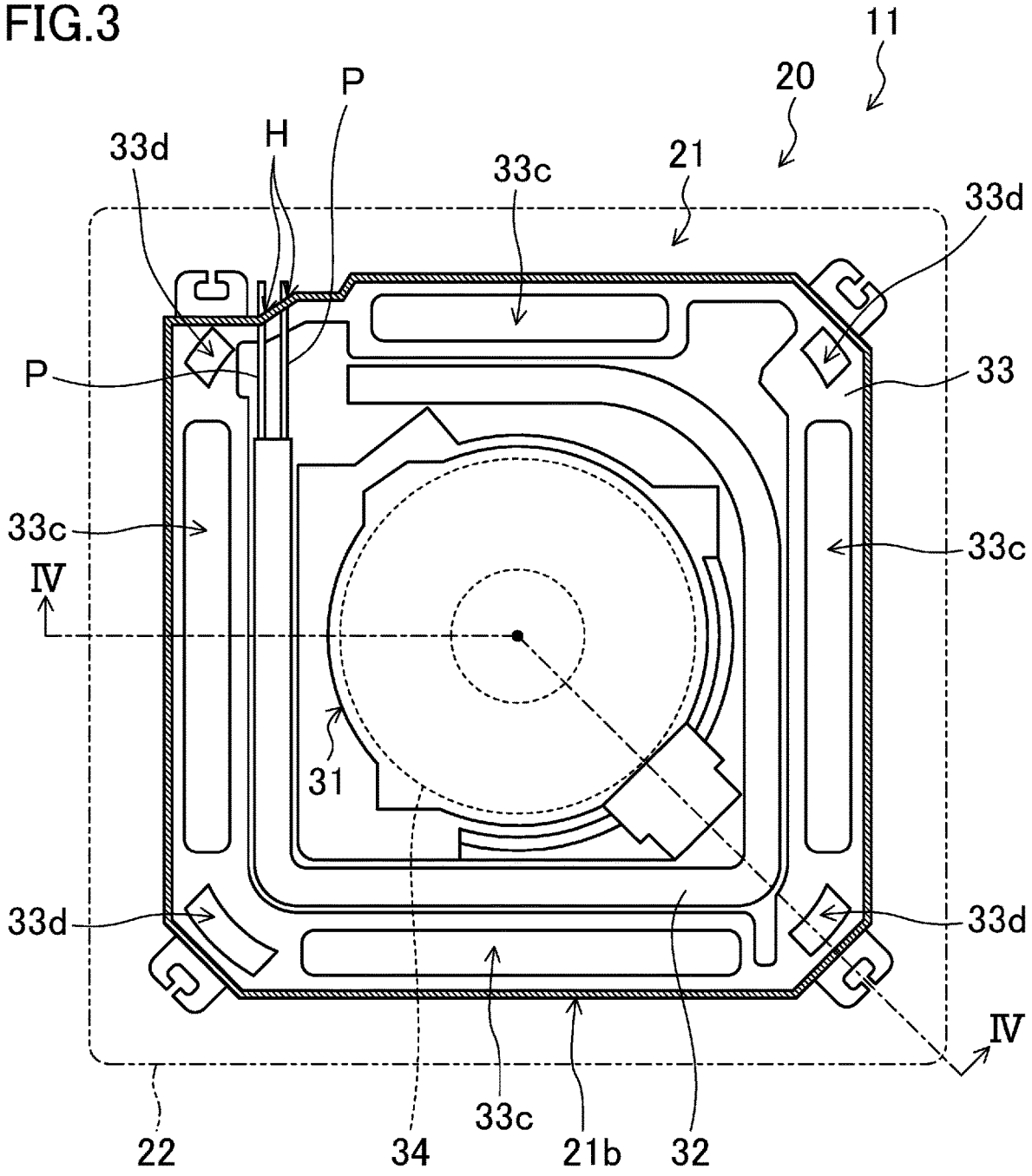
FIG. 3 is a schematic plan view of the indoor unit without the top plate when viewed from above.
Figure 4:
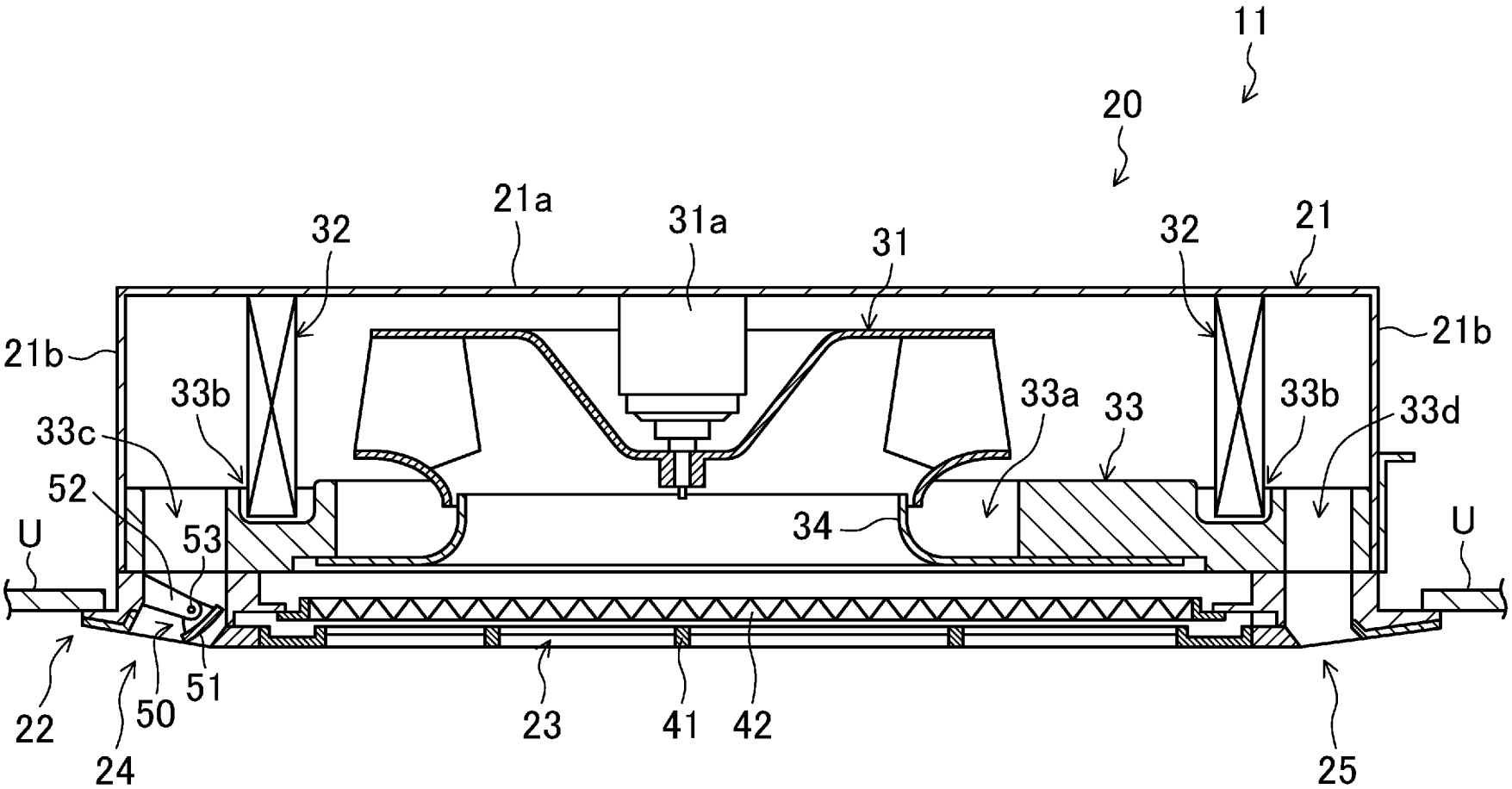
FIG. 4 is a schematic cross-section of the indoor unit taken along the line IV-IV of FIG. 3.
Figure 5:
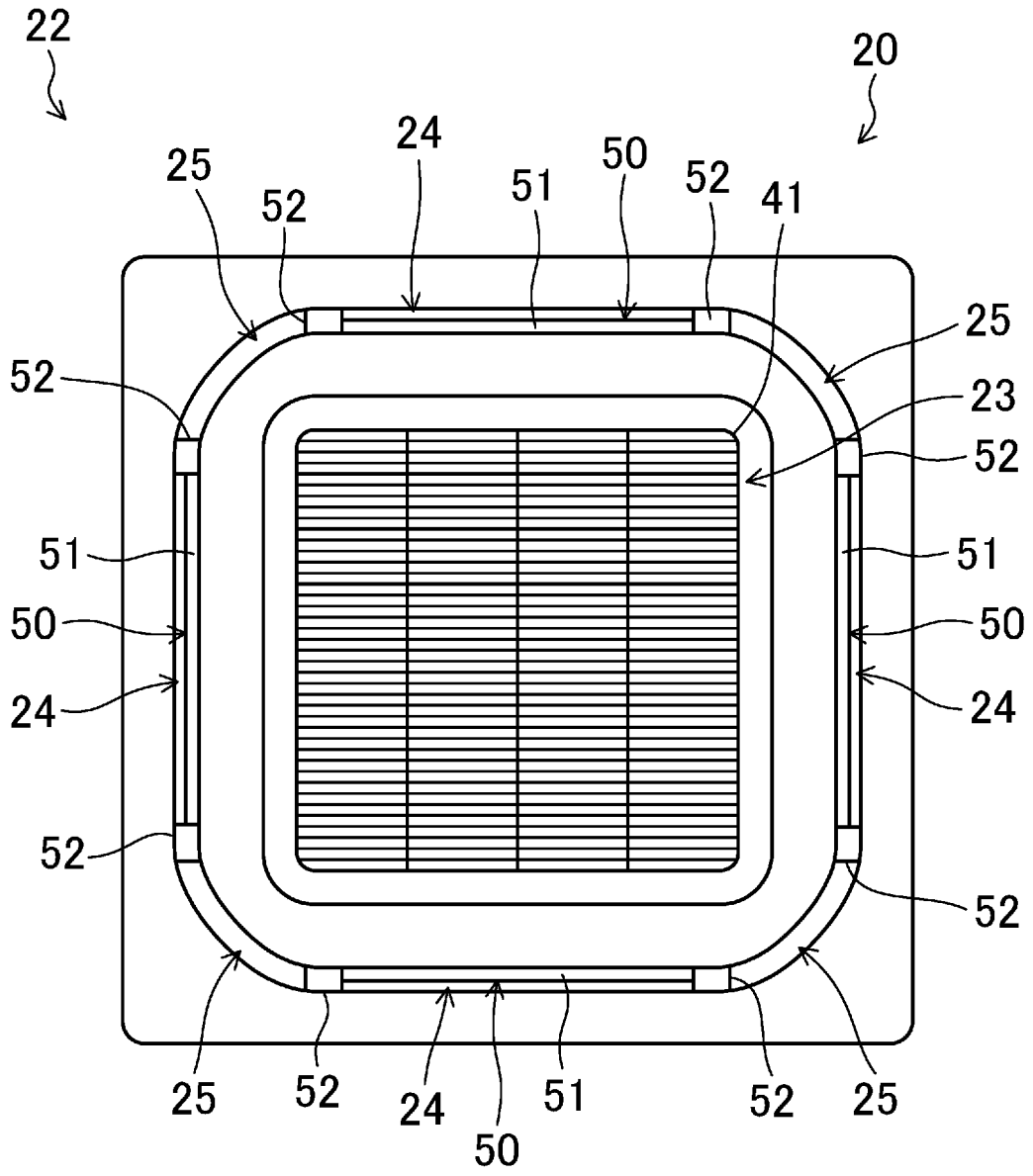
FIG. 5 is a schematic view of the bottom surface of the indoor unit.

FIG. 2 is a schematic perspective view of the indoor unit (11) when viewed diagonally from below the indoor unit (11). FIG. 3 is a schematic plan view of the indoor unit (11) without the top plate (21*a*) when viewed from above. FIG. 4 is a schematic cross-section of the indoor unit (11) taken along the line IV-IV of FIG. 3. FIG. 5 is schematic view of the bottom surface of the indoor unit (11).

<Casing Body>

The casing body (21) is positioned in an opening formed in the ceiling (U) of the room space (R) by being inserted into the opening. The casing body (21) has a box-like, generally rectangular parallelepiped shape with an open bottom end. The casing body (21) has the top plate (21*a*) having a generally square plate-like shape, and four side panels (21*b*) each having a generally rectangular plate-like shape and extending downward from a peripheral portion of the top plate (21*a*). The casing body (21) houses the indoor fan (31), the indoor heat exchanger (32), the drain pan (33), and the bell mouth (34). One of the four side panels (21*b*) is provided with a through hole (H) through which an indoor refrigerant pipe (P), which connects the indoor heat exchanger (32) with the connection pipes (2, 3), can pass.

<Indoor Fan>

The indoor fan (31) is located at a central portion in the casing body (21). The indoor fan (31) draws air from under the casing and blows the air out in a radially outward direction. In this example, the indoor fan (31) is configured as a centrifugal fan and is actuated by the indoor fan motor (31*a*) located at the center of the top plate (21*a*) of the casing body (21).

<Indoor Heat Exchanger>

The indoor heat exchanger (32) has a refrigerant pipe (i.e., a heat-transfer tube) and is arranged such that the refrigerant pipe is bent to surround the indoor fan (31). The indoor heat exchanger (32) exchanges heat between the refrigerant flowing in the heat-transfer tube (not shown) provided therein and the air drawn into the casing body (21). For example, the indoor heat exchanger (32) is configured as a fin-and-tube heat exchanger. Further, the indoor heat exchanger (32) functions as a refrigerant evaporator in a cooling operation, thereby cooling the air, and functions as a refrigerant condenser (i.e., a radiator) in a heating operation, thereby heating the air.

<Drain Pan>

The drain pan (33) has a generally rectangular parallelepiped shape and is thin in the vertical dimension. The drain pan (33) is placed under the indoor heat exchanger (32). An intake passage (33*a*) is provided at a central portion of the drain pan (33), a water receiving groove (33*b*) at a top surface of the rain pan (33), and four first blowing passages (33*c*) and four second blowing passages (33*d*) at a peripheral portion of the drain pan (33). The intake passage (33*a*) passes through the drain pan (33) in the vertical direction. The water-receiving groove (33*b*) is annular and surrounds the intake passage (33*a*) in a plan view. The four first blowing passages (33*c*) extend along the four sides of the drain pan (33) so as to surround the water-receiving groove (33*b*) when viewed in plan. The four first blowing passages (33*c*) pass through the drain pan (33) in the vertical direction. The four second blowing passages (33*d*) are located at four corners of the drain pan (33) when viewed in plan, and pass through the drain pan (33) in the vertical direction.

<Bell Mouth>

The bell mouth (34) has a cylindrical shape, an open area of which increases from top to bottom end. Further, the upper open end of the bell mouth (34) is inserted in an intake hole (i.e., the lower open end) of the indoor fan (31) and is accommodated in the intake passage (33*a*) of the drain pan (33). This configuration leads the air drawn through the lower open end of the bell mouth (34) to the intake hole of the indoor fan (31).

<Decorative Panel>

The decorative panel (22) has a generally cubic shape and is thin in the vertical direction. Further, an intake hole (23) is provided at a central portion the decorative panel (22) and outlet ports (26) are provided at a peripheral portion the decorative panel (22). The outlet ports (26) blow the conditioned air out in a plurality of directions different from one another. Specifically, the outlet ports (26) formed in the decorative panel (22) are configured as four first outlet ports (24), which are primary outlet ports, and four second outlet ports (25), which are secondary outlet ports.

<<Intake Hole>>

The intake hole (23) passes through the decorative panel (22) in the vertical direction and communicates with the interior space of the bell mouth (34). The intake hole (23) is arranged adjacent to the four first outlet ports (24) and is configured to draw in the room air. In the present embodiment, the intake hole (23) has a generally square shape in when viewed in plan. Further, the intake hole (23) is provided with an intake grill (41) and an intake filter (42). The intake grill (41) has a generally square shape and is provided with a large number of through holes at a central portion. The intake grill (41) is attached to the intake hole (23) of the decorative panel (22) to cover the intake hole (23). The intake filter (42) catches dust in the air drawn through the intake grill (41).

<<Outlet Port>>

The four first outlet ports (24) are straight ports extending along the four sides of the decorative panel (22) so as to surround the intake hole (23) when viewed in plan. Each of the first outlet ports (24) passes through the decorative panel (22) in the vertical direction to communicate with an associated one of the first blowing passages (33*c*) of the drain pan (33). In the present embodiment, the first outlet port (24) has a generally rectangular shape when viewed in plan. The four first outlet ports (24) are configured to blow the conditioned air out in different directions. The four second outlet ports (25) are located at the four corners of the decorative panel (22) and are curved when viewed in plan. Each of the second outlet ports (25) passes through the decorative panel (22) in the vertical direction to communicate with an associated one of the second blowing passages (33*d*) of the drain pan (33).

<Flow of Air in Indoor Unit>

Now, flow of air in the indoor unit (11) will be described with reference to FIG. 4. First, when the indoor fan (31) is actuated, the room air is drawn into the indoor fan (31) from the room space (R) after sequentially passing through the intake grill (41) and the intake filter (42) which are provided for the intake hole (23) of the decorative panel (22) and through the interior space of the bell mouth (34). The air taken into the indoor fan (31) is blown out in a lateral direction of the indoor fan (31), and exchanges heat with the refrigerant flowing through the indoor heat exchanger (32) when the air passes through the indoor heat exchanger (32). Thus, the air passing through the indoor heat exchanger (32) is cooled when the indoor heat exchanger (32) functions as an evaporator (i.e., during a cooling operation), and is heated when the indoor heat exchanger (32) functions as a condenser (i.e., during a heating operation). The conditioned air which has passed through the indoor heat exchanger (32) is divided and flows into the four first blowing passages (33*c*) and the four second blowing passages (33*d*), and is thereafter blown out from the four first outlet ports (24) and the four second outlet ports (25) into the room space (R).

<Wind Direction Adjusting Blade>

Each of the first outlet ports (24) is provided with a wind direction adjusting blade (51) for adjusting the wind direction of the conditioned air flowing in each first blowing passage (33*c*). The wind direction adjusting blade (51) has a flat plate-like shape extending from one end to the other end of the longitudinal dimension of the first outlet port (24) of the decorative panel (22). The wind direction adjusting blade (51) is supported by support members (52) and is freely rotatable about a central shaft (53) extending in the longitudinal direction of the blade. The wind direction adjusting blade (51) has an arc-shaped cross-section (i.e., the cross-section orthogonal to the longitudinal dimension) which forms a convex curve relative to the central shaft (53) of swing motion.

Figure 6A:
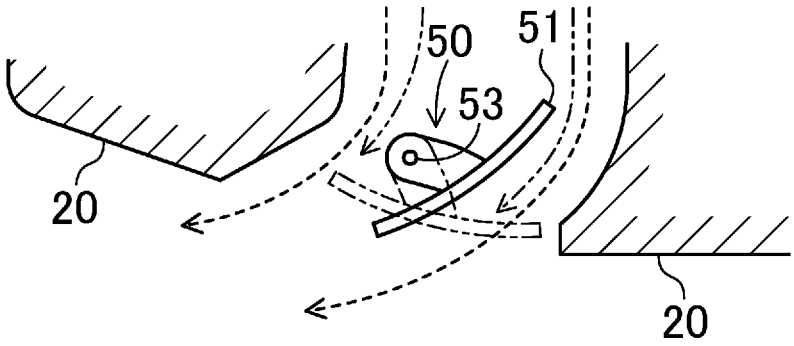
FIG. 6A is a partial cross-section of the indoor unit in a state in which a wind direction adjusting blade is set to a horizontal blow position.
Figure 6B:
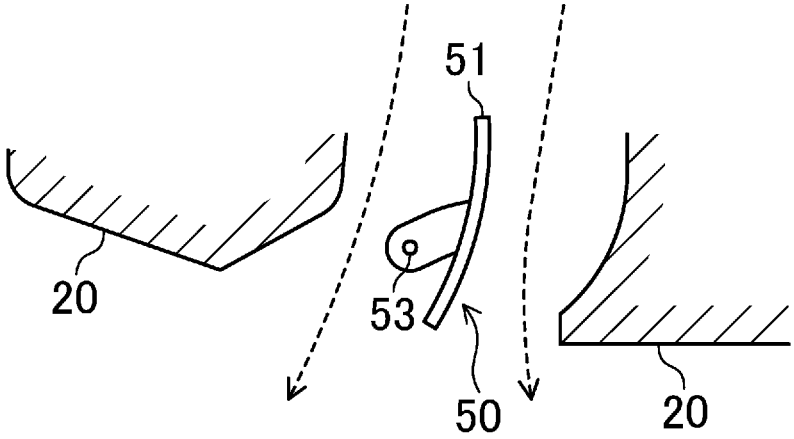
FIG. 6B is a partial cross-section of the indoor unit in a state in which the wind direction adjusting blade is set to a downward blow position.
Figure 6C:
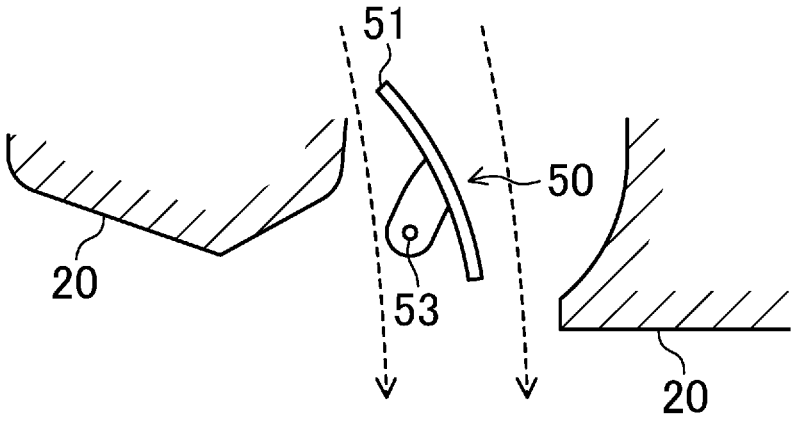
FIG. 6C is a partial cross-section of the indoor unit in which the wind direction adjusting blade is set to a blow restriction position.

The wind direction adjusting blade (51) is a movable blade. The position of the wind direction adjusting blade (51) may be set to a horizontal blow position, shown in FIG. 6A, corresponding to a horizontal blow mode in which the conditioned air is blown in the horizontal direction from the first outlet port (24), a downward blow position, shown in FIG. 6B, corresponding to a downward blow mode in which the air is blown downward from the first outlet port (24), and a blow restriction position, shown in FIG. 6C, corresponding to a wind block mode in which the flow of the conditioned air from the first outlet ports (24) is reduced. The horizontal blow mode is a mode in which the conditioned air is blown in a direction that leads the conditioned air to the perimeter zone of the room space (R). Specifically, in the horizontal blow mode, the wind direction adjusting blade (51) is arranged at its most upwardly-facing position within a general range of adjustment. In the horizontal blow mode of the present embodiment, the conditioned air is blown downward from the first outlet port (24) at an angle of 20° with respect to a horizontal plane.

In the present embodiment, the position of the wind direction adjusting blade (51) is controlled by an airflow control section of an operation control section (70), which is a control board as illustrated in FIG. 1. The horizontal blow mode, the downward blow mode, or the wind block mode may be selected at each first outlet port (24) by controlling the position of the wind direction adjusting blade (51). Specifically, the airflow control section of the operation control section (70) can select the horizontal blow mode in which the wind direction adjusting blade (51) is set to the horizontal blow position, the downward blow mode in which the wind direction adjusting blade (51) is set to the downward blow position to blow the air toward the floor (F) of the air-conditioning target space (R), or the wind block mode in which the wind direction adjusting blade (51) is set to the blow restriction position.

The wind direction adjusting blades (51) provided at the four first outlet ports (24) may be controlled independently from one another by the airflow control section of the operation control section (70). If the wind direction adjusting blade (51) of at least one of the four first outlet ports (24) is set to the blow restriction position, the gap between the first outlet port (24) and the wind direction adjusting blade (51) becomes narrower such that air becomes harder to be blown out from said first outlet port (24). As a result, the blowing speed of the conditioned air from the other first outlet ports (24) increases. That is, the airflow control section of the operation control section (70) is configured to carry out an airflow rate adjusting operation in which the angle of the wind direction adjusting blade (51) is controlled to reduce the flow of the conditioned air in one or more directions (two blowing directions in the present embodiment) of a plurality of blowing directions (four blowing directions in the present embodiment), thereby increasing the speed of the air blown out in the rest of the blowing directions (the other two blowing directions in the present embodiment).

The airflow control section of the operation control section (70) is configured to control the flow of the conditioned air such that the conditioned air is blown out in the horizontal blow mode in the blowing direction in which the blowing speed is increased by the airflow rate adjusting operation. Further, the airflow control section of the operation control section (70) is configured to carry out the airflow rate adjusting operation by controlling the angle of the wind direction adjusting blade (51) and thereby periodically changing the blowing direction in which a reduced amount of the conditioned air is blown.

When the wind direction adjusting blade (51) is set to the blow restriction position, the conditioned air blown out from the first outlet port (24) having said wind direction adjusting blade (51) is small in amount and low in speed. Hence, a short-circuit, in which the conditioned air does not flow to the air-conditioning target space (R) but is directly drawn into the intake hole (23), occurs. In other words, the airflow control section of the operation control section (70) is configured to control the flow of the conditioned air blown out from the first outlet port (24) corresponding to the blowing direction in which a reduced amount of the conditioned air is blown in the airflow rate adjusting operation, such that the conditioned air is blown out toward the intake hole (23) and drawn into the intake hole (23). In the indoor unit (11) of the present embodiment, the wind direction adjusting blades (51) are provided at only the first outlet ports (24) and are not provided at the second outlet ports (25).

Figure 7:
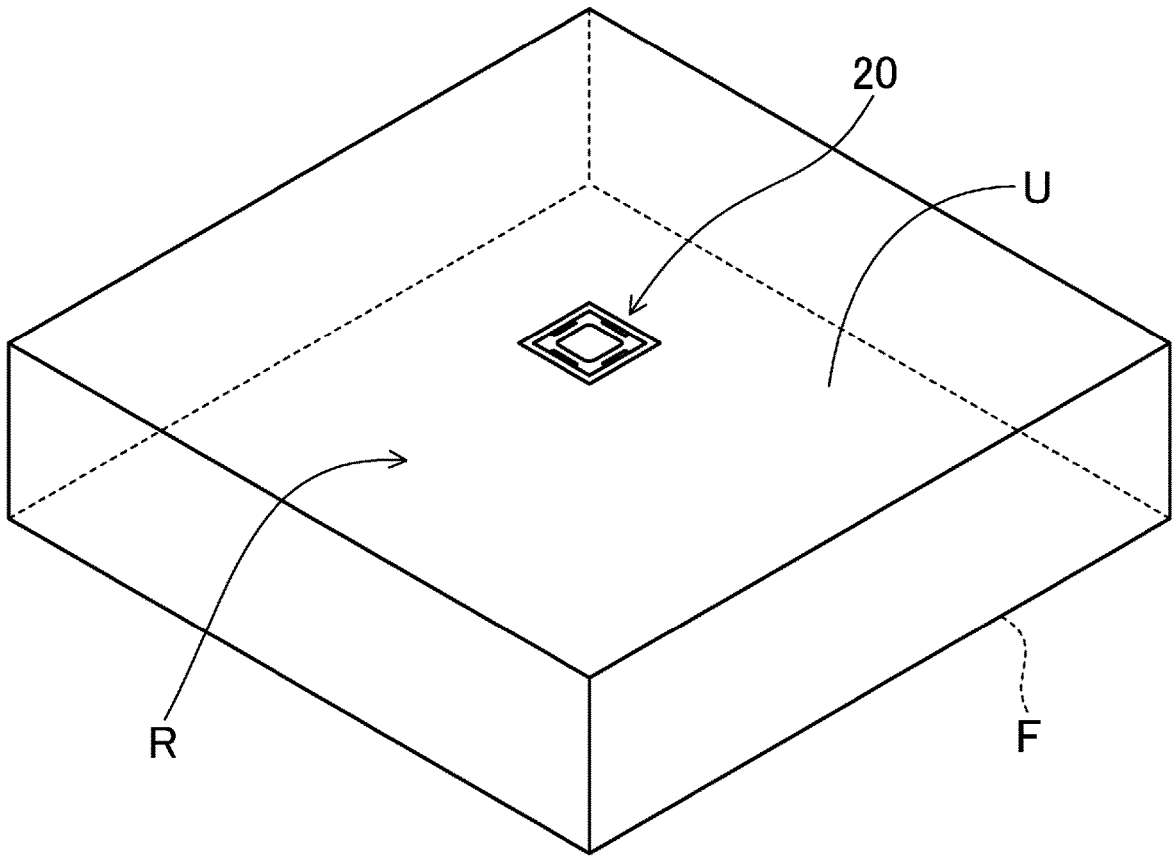
FIG. 7 is a perspective view illustrating an example arrangement of the indoor unit in a room.
Figure 8A:
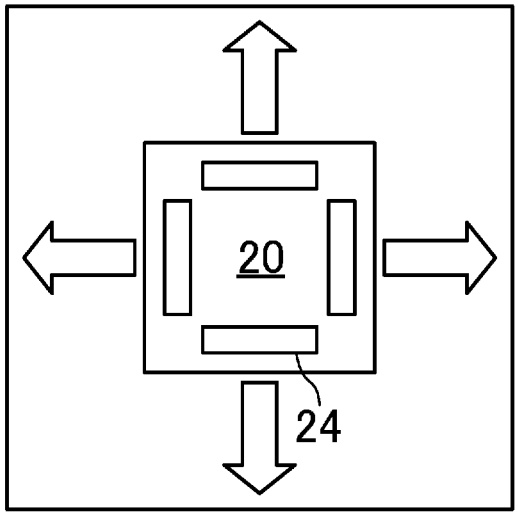
FIG. 8A generally illustrates simultaneous blowing in four directions.
Figure 8B:
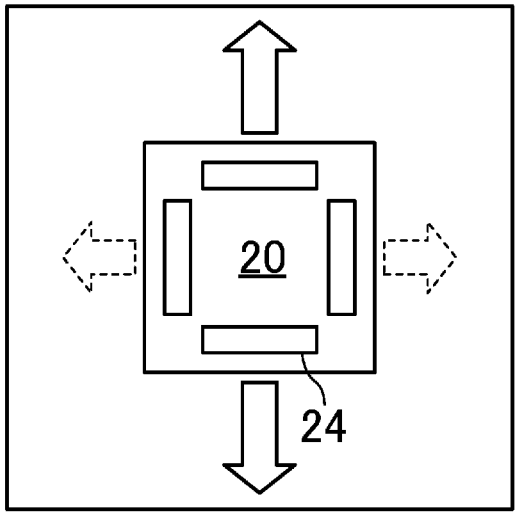
FIG. 8B generally illustrates alternate blowing in two directions.

For example, the single casing (20) of the indoor unit (11) is installed in the center of a room having a square ceiling (U) and floor (F), as illustrated in FIG. 7. As described above, the casing (20) of the indoor unit (11) has the four first outlet ports (24) which allow the conditioned air to be blown out evenly in the four directions in the horizontal blow mode, as illustrated in FIG. 8A, allow the conditioned air to be blown out in only two opposite directions in the horizontal blow mode, as illustrated in FIG. 8B, and allow the conditioned air to be blown out in only two predetermined directions in the horizontal blow mode, as will be described later with reference to FIGS. 9-16.

<Load Detection Section>

The indoor unit (11) is provided with a load detection section (71) which detects, for each of the blowing directions of the conditioned air, whether an area of the perimeter zone present at the circumference of the room space (R), i.e., an air-conditioning target space, is a high load area (Ac) or a low load area (Ah). The high load area (Ac) has a relatively large air conditioning load in the heating operation. The low load area (Ah) has a smaller air conditioning load than the high load area (Ac). As illustrated in FIG. 2, the load detection section (71) is provided at a single location of the bottom surface of the decorative panel (22). The load detection section (71) detects a surface temperature (e.g., the temperature of the floor surface, the temperature of the desk placed on the floor, etc.) of first to fourth detection areas (Sa to Sd, see FIG. 9, FIG. 11, FIG. 13, and FIG. 15) of the room space (R) by means of, for example, an infrared ray sensor. The load detection section (71) then compares the detected temperature with a predetermined threshold temperature to detect the high load area (Ac) and the low load area (Ah). Specifically, the load detection section (71) includes a sensor section (71*a*) and a load determination section provided in the operation control section (70). The sensor section (71*a*) outputs the detected temperature. The load determination section of the operation control section (70) compares the temperature detected by the sensor section (71*a*) with a predetermined threshold temperature, and divides the four detection areas (Sa to Sd) corresponding to the four first outlet ports (24) into the high load area (Ac) and the low load area (Ah). In FIG. 9, FIG. 11, FIG. 13, and FIG. 15, the high load area (Ac) is depicted in a relatively sparse dot pattern, and the low load area (Ah) is depicted in a relatively dense dot pattern.

The airflow control section of the operation control section (70) is configured to carry out the above-described airflow rate adjusting operation such that an accumulated value of flow rates of air into the high load area (Ac) in a predetermined reference time will be greater than an accumulated value of flow rates of air into the low load area (Ah) in the predetermined reference time. The airflow control section accomplishes this operation by controlling, in the horizontal blow mode, the angle of the wind direction adjusting blade (51) of each of the first outlet ports (24), based on the detection result of the load detection section (71), and thereby periodically changing the blowing direction in which a reduced amount of the conditioned air is blown.

—Operation—

Now, operation of the air conditioner (1) according to the present embodiment will be described. The air conditioner (1) switches between a cooling operation and a heating operation.

<Cooling Operation>

In the cooling operation, the four-way switching valve (15) illustrated in FIG. 1 is in the state indicated by the solid line, and the compressor (12), the indoor fan (31), and the outdoor fan (16) are actuated. The refrigerant circuit (C) thus performs a refrigeration cycle in which the outdoor heat exchanger (13) functions as a condenser and the indoor heat exchanger (32) functions as an evaporator.

Specifically, the high-pressure refrigerant compressed by the compressor (12) flows through the outdoor heat exchanger (13) to exchange heat with outdoor air. In the outdoor heat exchanger (13), the high-pressure refrigerant dissipates heat into the outdoor air and is condensed. The refrigerant condensed by the outdoor heat exchanger (13) is conveyed to the indoor unit (11). In the indoor unit (11), the refrigerant is decompressed by the indoor expansion valve (39) and then flows through the indoor heat exchanger (32).

In the indoor unit (11), the room air travels up through the intake hole (23) and then through the interior space of the bell mouth (34), and is drawn into the indoor fan (31). The air is blown out radially outward from the indoor fan (31). This air passes through the indoor heat exchanger (32) and exchanges heat with the refrigerant. In the indoor heat exchanger (32), the refrigerant absorbs heat from the room air and evaporates, and the air is cooled by the refrigerant.

The conditioned air cooled by the indoor heat exchanger (32) is divided into the blowing passages (33*c*, 33*d*) and flows down to be supplied to the room space (R) through the outlet ports (24, 25). The refrigerant evaporated by the indoor heat exchanger (32) is sucked into the compressor (12) and is compressed again.

<Heating Operation>

In the heating operation, the four-way switching valve (15) illustrated in FIG. 1 is in the state indicated by the broken line, and the compressor (12), the indoor fan (31), and the outdoor fan (16) are actuated. The refrigerant circuit (C) thus performs a refrigeration cycle in which the indoor heat exchanger (32) functions as a condenser and the outdoor heat exchanger (13) functions as an evaporator.

Specifically, the high-pressure refrigerant compressed by the compressor (12) flows through the indoor heat exchanger (32) of the indoor unit (11). In the indoor unit (11), the room air travels up through the intake hole (23) and then through the interior space of the bell mouth (34), and is drawn into the indoor fan (31). The air is blown out radially outward from the indoor fan (31). This air passes through the indoor heat exchanger (32) and exchanges heat with the refrigerant. In the indoor heat exchanger (32), the refrigerant dissipates heat into the room air and is condensed, and the air is heated by the refrigerant.

The conditioned air heated by the indoor heat exchanger (32) is divided into the blowing passages (33*c*, 33*d*) and flows down to be supplied to the room space (R) through the outlet ports (24, 25). The refrigerant condensed by the indoor heat exchanger (32) is decompressed by the outdoor expansion valve (14) and then flows through the outdoor heat exchanger (13). In the outdoor heat exchanger (13), the refrigerant absorbs heat from the outdoor air and evaporates. The refrigerant evaporated in the outdoor heat exchanger (13) is sucked into the compressor (12) and is compressed again.

<Airflow Control in Heating Operation>

In the heating operation, the load detection section (71) provided in the indoor unit (11) detects, for each of the blowing directions of the conditioned air, whether an area is the high load area (Ac) having a relatively large air conditioning load or the low load area (Ah) having a smaller air conditioning load than the high load area (Ac), thereby carrying out the above-described airflow rate adjusting operation. Specifically, the airflow rate adjusting operation is carried out, while taking into account four cases which will be described below. In the description of the airflow control described below, the four first outlet ports (24) of the indoor unit (11) are distinguished from one another in FIG. 10, FIG. 12, FIG. 14, and FIG. 16 as a first outlet port (24*a*) on the upper side of the drawings, a first outlet port (24*b*) on the right side of the drawings, a first outlet port (24*c*) on the lower side of the drawings, and a first outlet port (24*d*) on the left side of the drawings. In FIG. 9, FIG. 11, FIG. 13 and FIG. 15, the conditioned air from the first outlet port (24*a*) is blown out to the first detection area (Sa); the conditioned air from the first outlet port (24*b*) is blown out to the second detection area (Sb); the conditioned air from the first outlet port (24*c*) is blown out to the third detection area (Sc); and the conditioned air from the first outlet port (24*d*) is blown out to the fourth detection area (Sd).

<<Case in which Four Areas are High Load Areas>>

Figure 9:
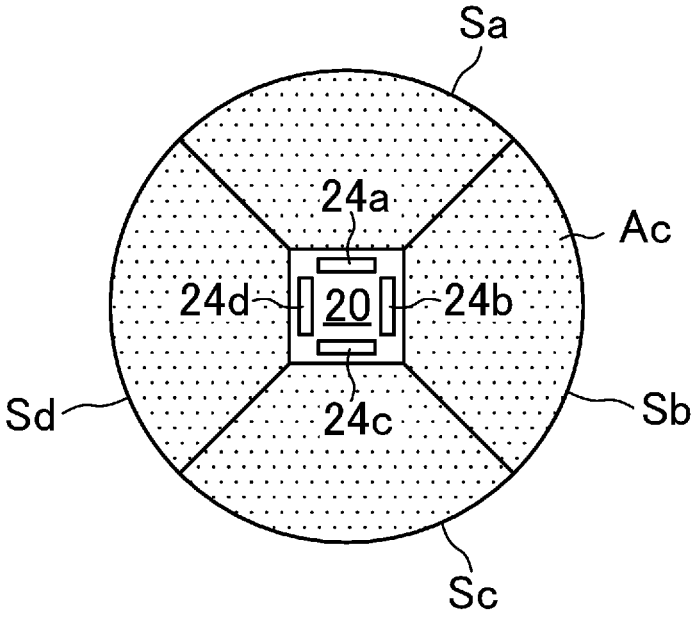
FIG. 9 generally illustrates a first load layout pattern of high load areas and low load areas in a detection area targeted for detection by a load detection section of the indoor unit.

As illustrated in FIG. 9, if the temperature values, detected by the sensor section (71*a*), of all the detection areas (Sa to Sd) of the room space (R) are smaller than a threshold temperature, all detection areas (Sa to Sd) are high load areas (Ac). In this case, as illustrated in FIG. 10, a blowing pattern (I) and a blowing pattern (II) are alternately carried out, for example for 60 seconds each.

Figure 10:
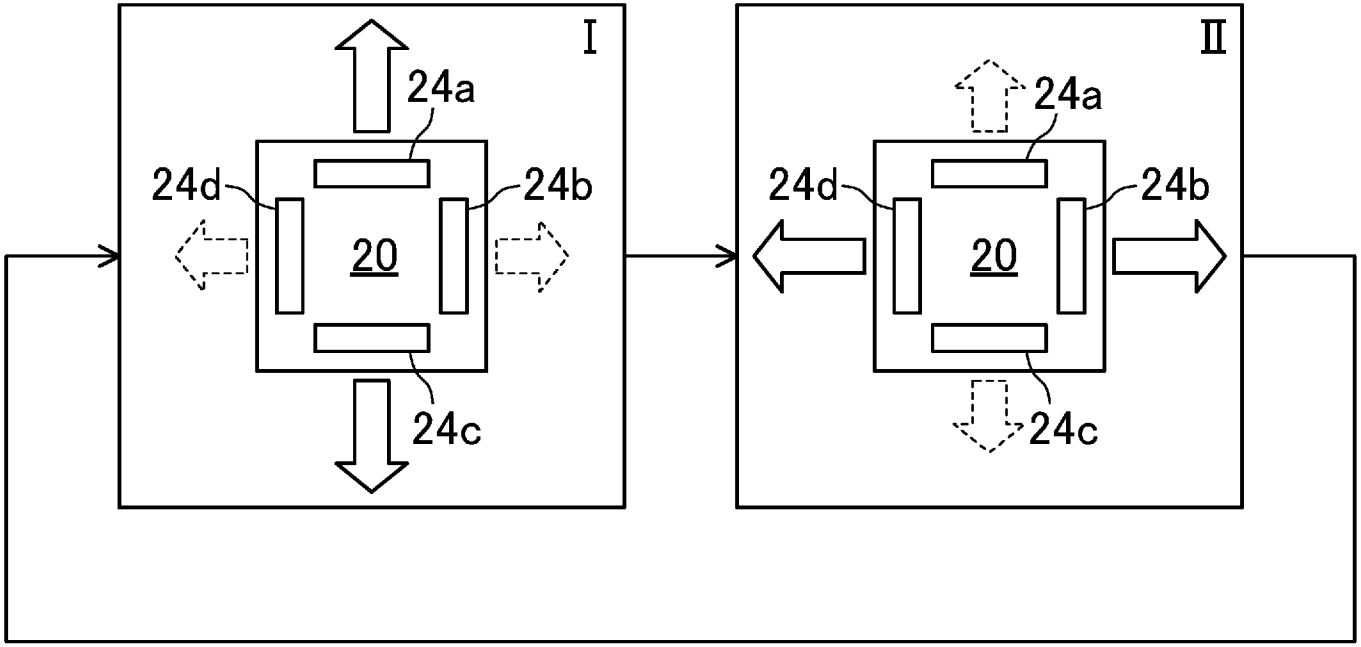
FIG. 10 is a diagram generally illustrating an airflow rate adjusting operation in the first load layout pattern shown in FIG. 9.

In the blowing pattern (I) of FIG. 10, the wind direction adjusting blades (51) of the two first outlet ports (24*b*, 24*d*) are set to the blow restriction position, and the wind direction adjusting blades (51) of the other two first outlet ports (24*a*, 24*c*) are set to the horizontal blow position. In the blowing pattern (II) of FIG. 10, the wind direction adjusting blades (51) of the two first outlet ports (24*a*, 24*c*) are set to the blow restriction position, and the wind direction adjusting blades (51) of the other two first outlet ports (24*b*, 24*d*) are set to the horizontal blow position.

In this case, the flow rates of air blown to the four high load areas (Ac) in a predetermined reference time (e.g., 60 seconds×2 patterns=120 seconds) are the same.

<<Case in which Three Areas are High Load Areas>>

Figure 11:
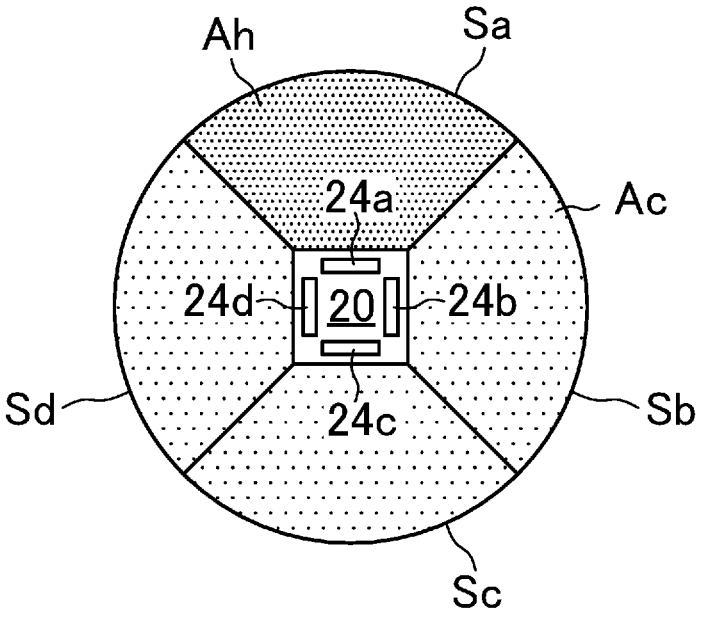
FIG. 11 generally illustrates a second load layout pattern of high load areas and low load areas in the detection area targeted for detection by the load detection section of the indoor unit.

As illustrated in FIG. 11, if the temperature value, detected by the sensor section (71*a*), of the first detection area (Sa) of the room space (R) is greater than a threshold temperature, and the temperature values, detected by the sensor section (71*a*), of the second to fourth detection areas (Sb to Sd) are lower than the threshold temperature, the first detection area (Sa) is the low load area (Ah) and the second to fourth detection areas (Sb to Sd) are the high load areas (Ac). In this case, as illustrated in FIG. 12, the blowing pattern (I), the blowing pattern (II) and a blowing pattern (III) are sequentially carried out, for example for 120 seconds each.

Figure 12:
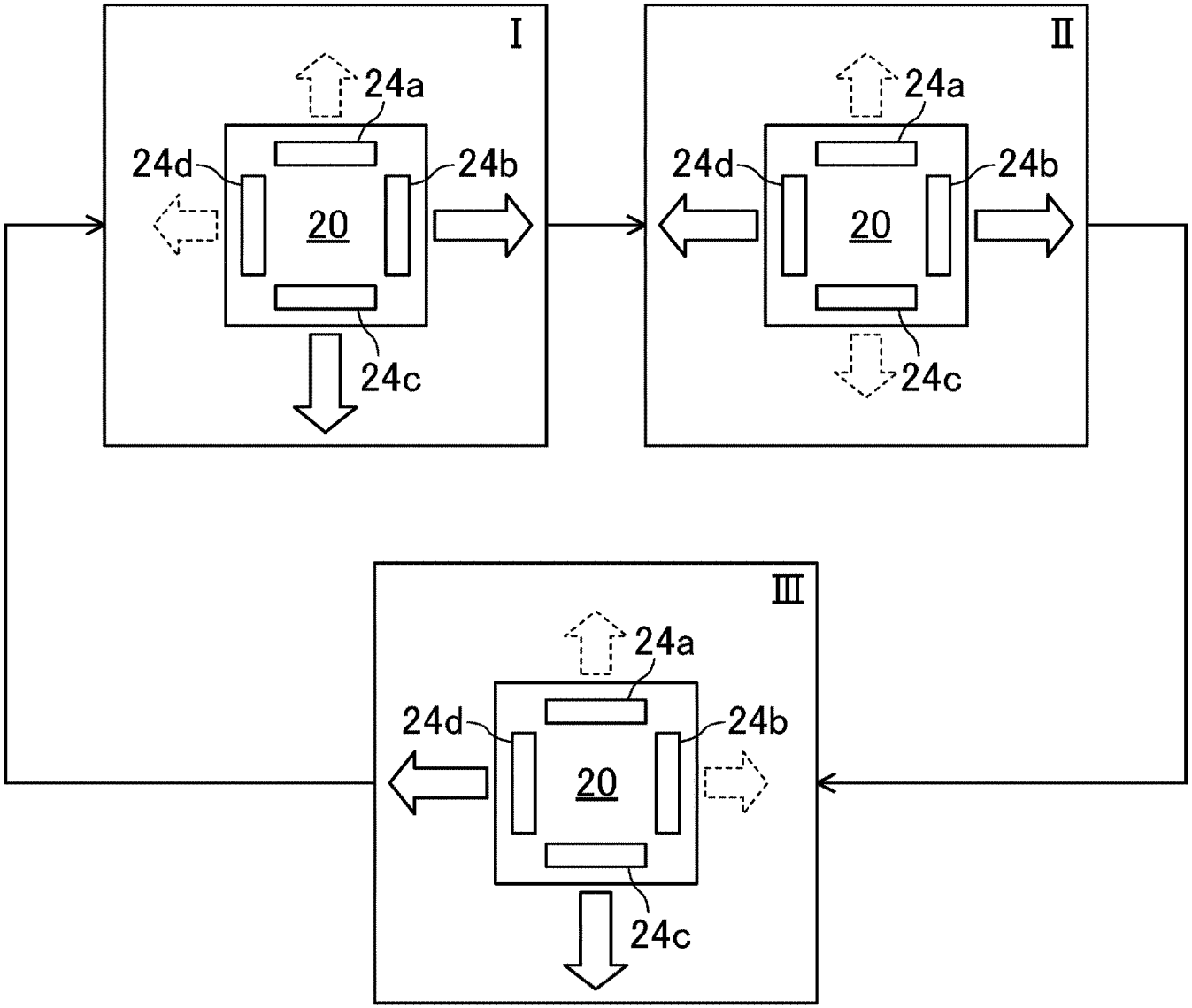
FIG. 12 is a diagram generally illustrating an airflow rate adjusting operation in the second load layout pattern shown in FIG. 11.

In the blowing pattern (I) of FIG. 12, the wind direction adjusting blades (51) of the two first outlet ports (24*a*, 24*d*) are set to the blow restriction position, and the wind direction adjusting blades (51) of the other two first outlet ports (24*b*, 24*c*) are set to the horizontal blow position. In the blowing pattern (II) of FIG. 12, the wind direction adjusting blades (51) of the two first outlet ports (24*a*, 24*c*) are set to the blow restriction position, and the wind direction adjusting blades (51) of the other two first outlet ports (24*b*, 24*d*) are set to the horizontal blow position. In the blowing pattern (III) of FIG. 12, the wind direction adjusting blades (51) of the two first outlet ports (24*a*, 24*b*) are set to the blow restriction position, and the wind direction adjusting blades (51) of the other two first outlet ports (24*c*, 24*d*) are set to the horizontal blow position.

That is, if there are a single low load area (Ah) and three high load areas (Ac), the flow of the conditioned air into the single low load area (Ah) and into any one of the three high load areas (Ac) is reduced in the airflow rate adjusting operation. In this airflow rate adjusting operation, the flow of the conditioned air into the single low load area (Ah) is reduced all the time, and the one high load area (Ac) to which the flow of the conditioned air is reduced is periodically changed among the three high load areas (Ac).

In this case, the accumulated value of the flow rates of air blown to the single low load area (Ah) in a predetermined reference time (e.g., 120 seconds×3 patterns=360 seconds) decreases, and the accumulated values of the flow rates of air blown to the three high load areas (Ac) in the predetermined reference time equally increase.

<<Case in which Two Areas are High Load Areas>>

Figure 13:
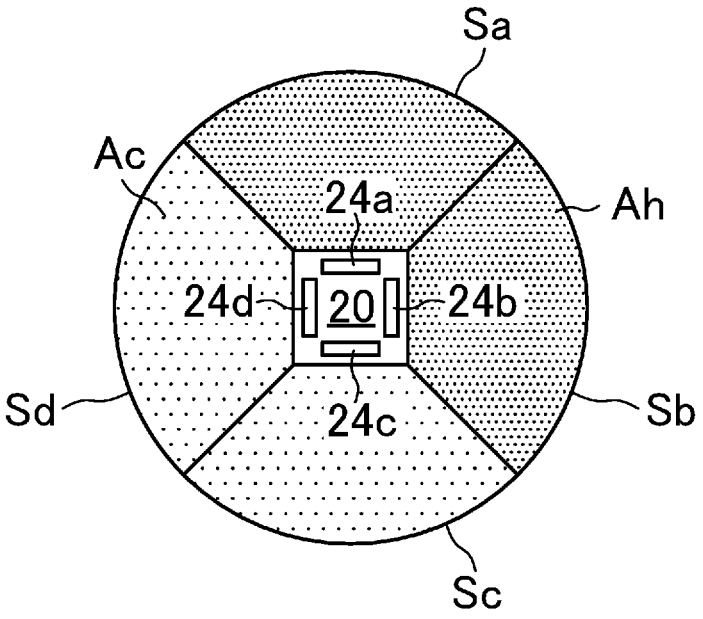
FIG. 13 generally illustrates a third load layout pattern of high load areas and low load areas in the detection area targeted for detection by the load detection section of the indoor unit.

As illustrated in FIG. 13, if the temperature values, detected by the sensor section (71*a*), of the first and second detection areas (Sa, Sb) of the room space (R) are greater than a threshold temperature, and the temperature values, detected by the sensor section (71*a*), of the third and fourth detection areas (Sc, Sd) are lower than the threshold temperature, the first and second detection areas (Sa, Sb) are low load areas (Ah) and the third and fourth detection areas (Sc, Sd) are high load areas (Ac). In this case, the blowing pattern (I) illustrated in FIG. 14 is repeated.

Figure 14:
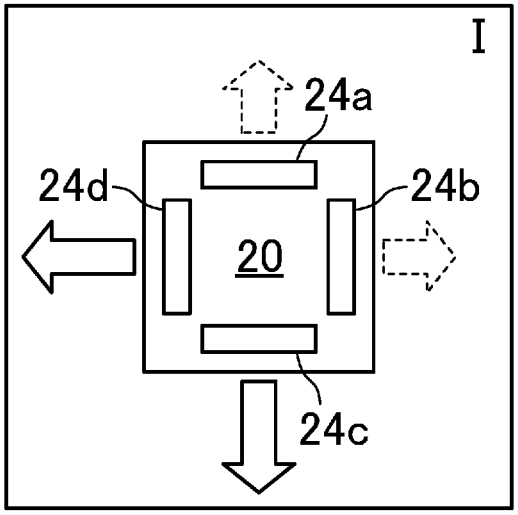
FIG. 14 is a diagram generally illustrating an airflow rate adjusting operation in the third load layout pattern shown in FIG. 13.

In the blowing pattern (I) of FIG. 14, the wind direction adjusting blades (51) of the two first outlet ports (24*a*, 24*b*) are set to the blow restriction position, and the wind direction adjusting blades (51) of the other two first outlet ports (24*c*, 24*d*) are set to the horizontal blow position. In this case, the flow of the conditioned air into the two low load areas (Ah) is reduced all the time.

<<The Case in which One Area is a High Load Area>>

Figure 15:
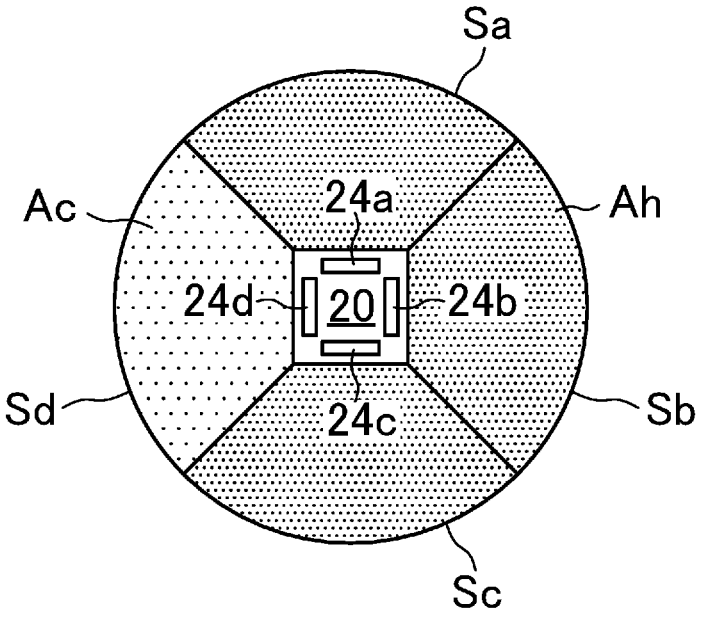
FIG. 15 generally illustrates a fourth load layout pattern of high load areas and low load areas in the detection area targeted for detection by the load detection section of the indoor unit.

As illustrated in FIG. 15, the temperature values, detected by the sensor section (71*a*), of the first to third detection areas (Sa to Sc) of the room space (R) are greater than a threshold temperature, and the temperature value, detected by the sensor section (71*a*), of the fourth detection area (Sd) is lower than the threshold temperature, the first to third detection areas (Sa to Sc) are low load areas (Ah), and the fourth detection area (Sd) is a high load area (Ac). In this case, as illustrated in FIG. 16, the blowing pattern (I), the blowing pattern (II) and the blowing pattern (III) are sequentially repeated, for example for 60 seconds each.

Figure 16:
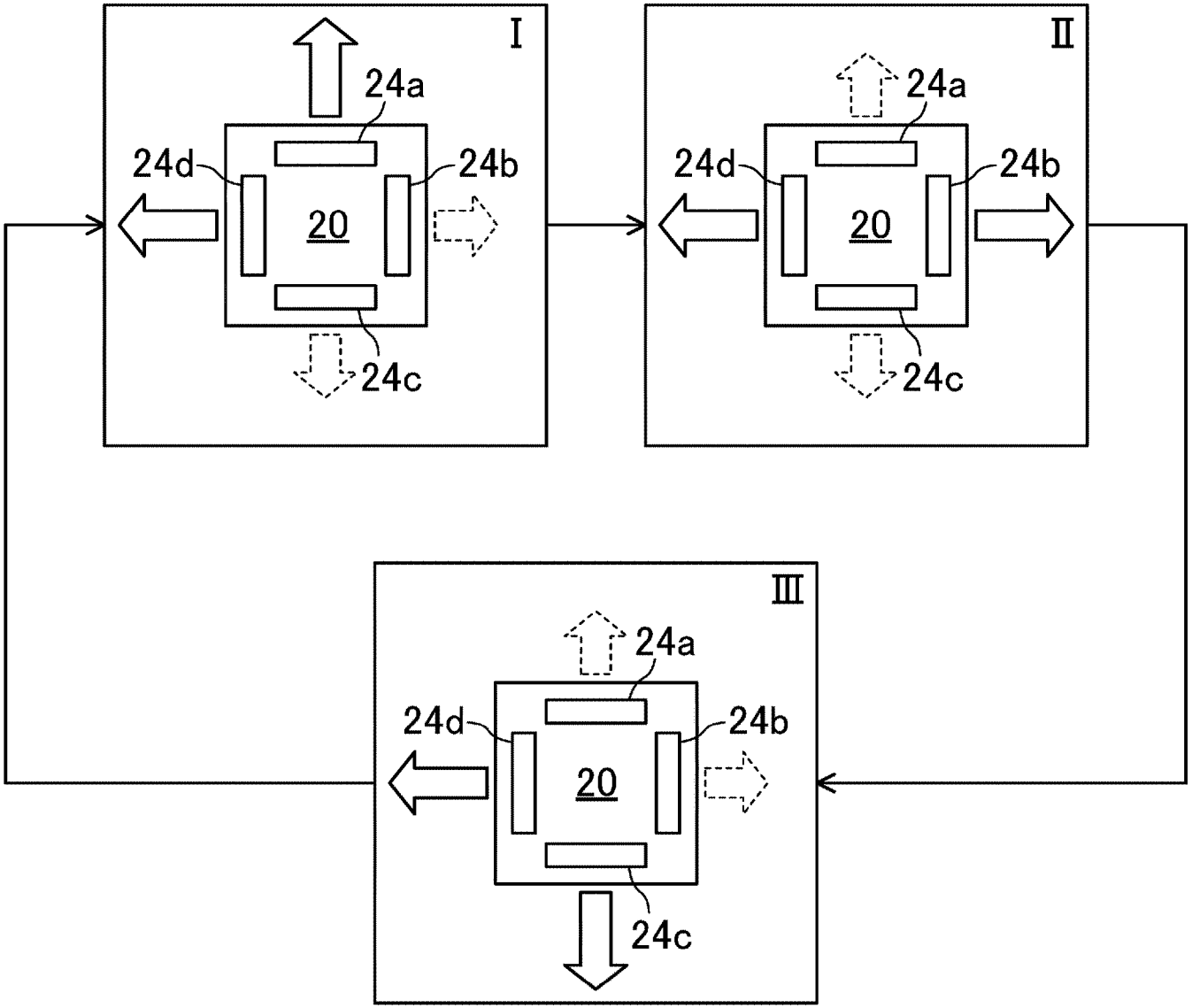
FIG. 16 is a diagram generally illustrating an airflow rate adjusting operation in the fourth load layout pattern shown in FIG. 15.

In the blowing pattern (I) of FIG. 16, the wind direction adjusting blades (51) of the two first outlet ports (24*b*, 24*c*) are set to the blow restriction position, and the wind direction adjusting blades (51) of the other two first outlet ports (24*a*, 24*d*) are set to the horizontal blow position. In the blowing pattern (II) of FIG. 16 the wind direction adjusting blades (51) of the two first outlet ports (24*a*, 24*c*) are set to the blow restriction position, and the wind direction adjusting blades (51) of the other two first outlet ports (24*b*, 24*d*) are set to the horizontal blow position. In the blowing pattern (III) of FIG. 16, the wind direction adjusting blades (51) of the two first outlet ports (24*a*, 24*b*) are set to the blow restriction position, and the wind direction adjusting blades (51) of the other two first outlet ports (24*c*, 24*d*) are set to the horizontal blow position.

That is, if there are three low load areas (Ah) and one high load area (Ac), the flow of the conditioned air into any two of the three low load areas is reduced in the airflow rate adjusting operation. In the airflow rate adjusting operation, the operation control section (70) periodically changes the two low load areas (Ah), to which the flow of conditioned air is reduced, among the three low load areas (Ah), so that the blowing speed of the conditioned air into the one high load area (Ac) is always kept high.

This operation results in an increase in the accumulated value of the flow rates of air blown into the single high load area (Ac) in a predetermined reference time (e.g., 60 seconds×3 patterns=180 seconds), and in an equal reduction of the accumulated values of the flow rates of air blown into the three low load areas (Ah) in the predetermined reference time.

—Verification by Simulation—

Figure 17:
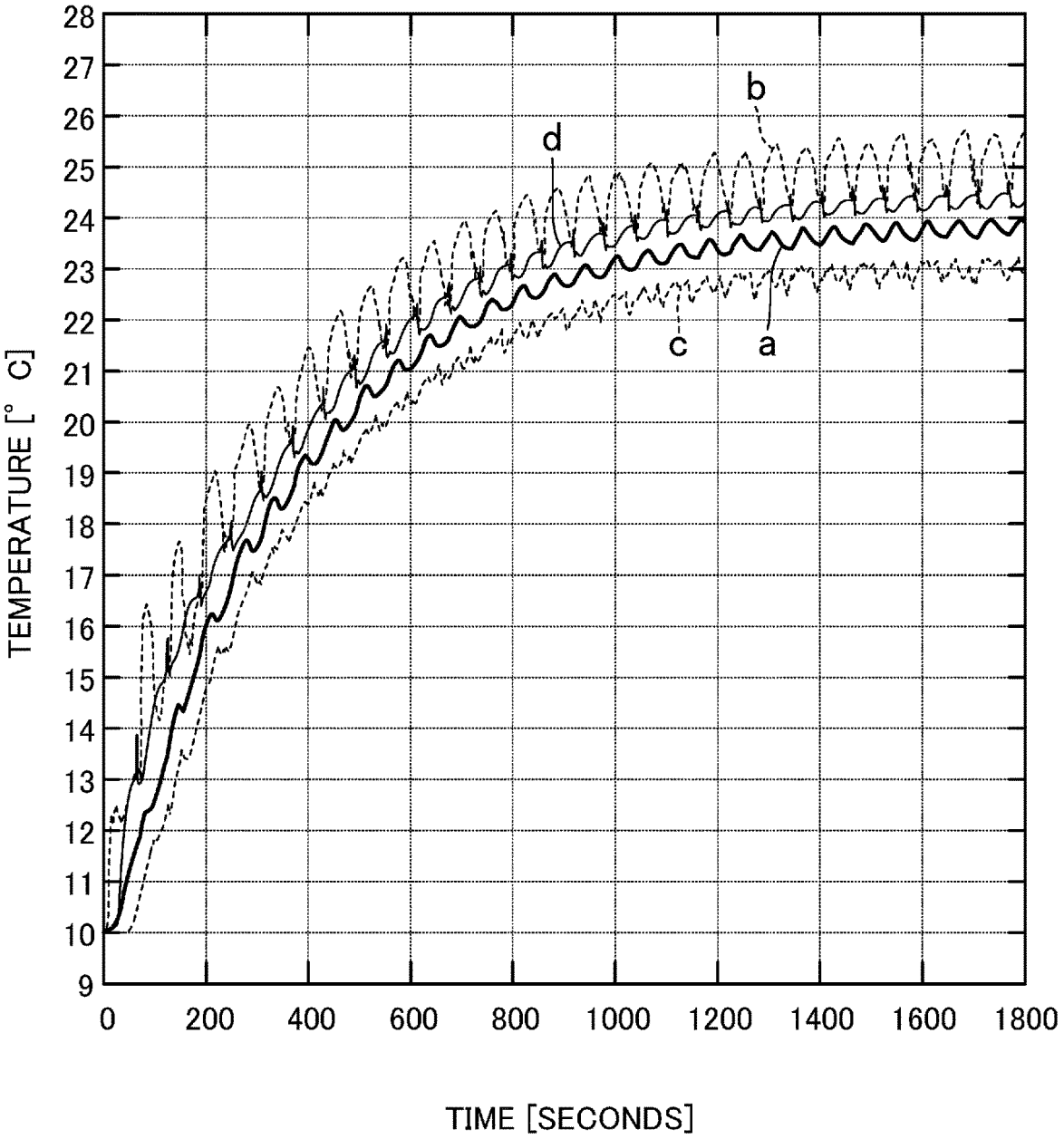
FIG. 17 is a graph showing temperature changes in the room in the case of the alternate blowing in two directions.
Figure 18:
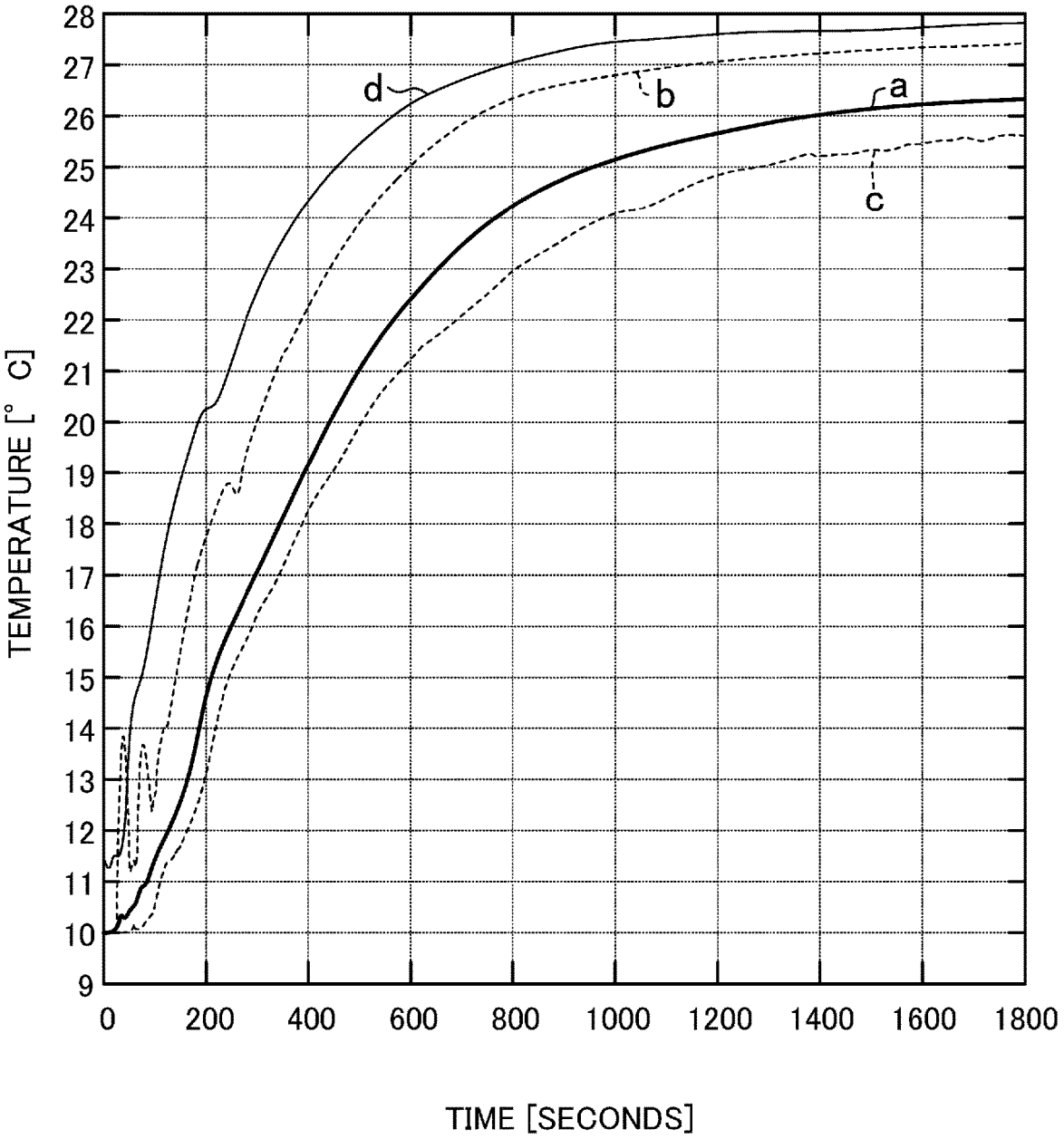
FIG. 18 is a graph showing temperature changes in the room in the case of the simultaneous blowing in four directions.

Results of a simulation performed for the case in which the above four areas are high load areas will be described. FIG. 17 is a graph showing temperature variations in a room when the air is alternately blown in two directions in Example. FIG. 18 is a graph showing temperature variations in a room when the air is simultaneous blown in the four directions in Comparative Example. In FIGS. 17 and 18, the bold solid line indicates a mean temperature at a height 0.6 meters above the floor surface; the broken line b indicates the highest temperature at the height 0.6 meters above the floor surface; the broken line c indicates the lowest temperature at the height 0.6 meters above the floor surface; and the thin solid line d indicates the temperature of the air drawn into the indoor unit.

In the Example and the Comparative Example, the room, which is an air-conditioning target space, is 9.9 meters square and 2.6 meters high. The outdoor temperature was set to 10° C. in all cases, with an initial indoor temperature of 10° C. In the Example, the conditioned air having a temperature of 40° C. was blown out in the two directions in the blowing pattern (I) and the two directions in the blowing pattern (II) alternately for 60 seconds each, as illustrated in FIG. 10. The conditioned air was blown downward at an angle of 20° with respect to the horizontal plane, and at a flow rate of 24 $m^3$ per minute. In the Comparative Example, the conditioned air having a temperature of 40° C. was blown out equally in the four directions, as illustrated in FIG. 8(A). The conditioned air was blown downward at an angle of 30° with respect to the horizontal plane, and at a flow rate of 36.5 $m^3$ per minute. In each of the Example and the Comparative Example, temperature variations in the room and temperature variations of air when drawn into the indoor unit were checked.

The result of the simulation of the Comparative Example was as follows, as shown in FIG. 18: the mean temperature reached 22° C. relatively quickly (i.e., in 566 seconds) due to the greater flow rate of the conditioned air compared to the Example; the temperature width (i.e., the difference between the highest temperature and the lowest temperature) during such a period was relatively wide; and the difference between the mean temperature and the temperature of air when drawn into the indoor unit was relatively big. On the other hand, the result of the simulation of the Example was as follows, as shown in FIG. 17: the mean temperature reached 22° C. relatively slowly (i.e., in 691 seconds) due to the smaller flow rate of the conditioned air compared to the Comparative Example; the temperature width (i.e., the difference between the highest temperature and the lowest temperature) during such a period was relatively narrow; and the difference between the mean temperature and the temperature of air when drawn into the indoor unit was relatively small. According to the results of these simulations, the Example exhibits smaller temperature variations in the room, and conceivably achieves more effective heating, than the Comparative Example. In the Comparative Example, warm air stays close to the ceiling in the room, and the area close to the floor of the room is difficult to heat. In other words, the temperature difference in the vertical direction is relatively large. In the Example, warm air does not stay close to the ceiling of the room, and the area close to the floor is easy to heat. In other words, the temperature difference in the vertical direction is relatively small.

Advantages of the Embodiment

According to the indoor unit (11) of the air conditioner (1) of the present embodiment, the casing (20) of the indoor unit (11) installed in the ceiling (U) of the room space (R) is provided with the outlet ports (26) capable of blowing out the conditioned air in a plurality of blowing directions different from one another, as described above. The airflow control section of the operation control section (70) of the indoor unit (11) carries out the airflow rate adjusting operation in which the airflow control section reduces the flow of the conditioned air in one or more of the plurality of blowing directions to increase the blowing speed in the rest of the blowing directions. In this airflow rate adjusting operation, the blowing speed of the conditioned air is increased in the direction other than the direction in which a reduced amount of the conditioned air is blown. Thus, the conditioned air blown out from the outlet ports (26) with increased air blowing speed travels further into the room space (R), which means that the conditioned air reaches the perimeter zone of the room space (R) more easily. Further, the airflow control section of the operation control section (70) periodically changes the blowing direction in which a reduced amount of the conditioned air is blown, in carrying out the airflow rate adjusting operation. In other words, the blowing direction in which the conditioned air is blown with increased speed is also changed periodically. As a result, the conditioned air blown out through the outlet ports (26) reaches the perimeter zone of the room space (R) more easily, which thus reduces the temperature variations in the room space (R).

Moreover, in the indoor unit (11) of the air conditioner (1) of the present embodiment, the load detection section (71) of the indoor unit (11) detects, for each of the blowing directions of the conditioned air, whether an area of the perimeter zone in the room space (R) is a high load area (Ac) having a relatively large air conditioning load or a low load area (Ah) having a smaller air conditioning load than the high load area (Ac). Further, in carrying out the airflow rate adjusting operation, the airflow control section of the operation control section (70) periodically changes the blowing direction in which a reduced amount of the conditioned air is blown, such that an accumulated value of the flow rate of air into the high load area (Ac) in a predetermined reference time will be greater than an accumulated value of the flow rate of air into the low load area (Ah) in the predetermined reference time. As a result, the flow rate of air into the high load area (Ac) of the air-conditioning target space (R) is increased and the flow rate of air into the low load area (Ah) of the air-conditioning target space (R) is reduced, which allows a further reduction in the temperature variations in the air-conditioning target space (R).

In general, the warm conditioned air being blown out in all of the blowing directions in the heating operation may easily result in overheating the room. In this respect, in the indoor unit (11) of the air conditioner (1) of the present embodiment, the flow of the warm conditioned air in one or more of the blowing directions is reduced. The risk of overheating the room may thus be reduced. That is, the indoor unit (11) of the present embodiment may reduce temperature variations in the room space (R) in the heating operation, while reducing the risk of overheating the room. In addition, the warm conditioned air easily reaches the perimeter zone of the room space (R) in the heating operation, which allows smooth circulation of the warm conditioned air in the room space (R) and hence achieves quick heating of the room space (R).

In the indoor unit (11) of the air conditioner (1) of the present embodiment, the airflow control section of the operation control section (70) controls the flow of the conditioned air such that the conditioned air is blown out in the horizontal blow mode in the blowing direction in which the blowing speed is increased by the airflow rate adjusting operation. Thus, the conditioned air may be circulated through the room space (R) in which the conditioned air blown out from the outlet port (26) of the indoor unit (11) installed in the ceiling (U) for example hits against a wall surface of the air-conditioning target space (R), flows sequentially along the wall surface and the floor (F), and is drawn into the indoor unit (11).

In the indoor unit (11) of the air conditioner (1) of the present embodiment, the outlet ports (26) include a plurality of first outlet ports (24) for blowing out the conditioned air in directions different from one another, and the casing (20) of the indoor unit (11) is provided with the intake hole (23) arranged adjacent to the first outlet ports (24) to draw in the room air. The airflow control section of the operation control section (70) controls, in the airflow rate adjusting operation, the flow of the conditioned air blown out from the first outlet port (24) corresponding to the blowing direction in which a reduced amount of the conditioned air is blown, such that the conditioned air is blown out toward the intake hole (23) and drawn into the intake hole (23). Thus, the conditioned air blown out through the first outlet port (24) corresponding to the blowing direction in which a reduced amount of the conditioned air is blown, is not blown into the room space (R) but is directly drawn into the intake hole (23) adjacent to the first outlet port (24). That is, a short-circuit of the airflow may be generated.

OTHER EMBODIMENTS

The above embodiment illustrates an example of the indoor unit (11) in which flow of the conditioned air is reduced in two of the four blowing directions of the conditioned air. However, the indoor unit of the present embodiment may also be configured to reduce the flow of the conditioned air in one or three of the four blowing directions of the conditioned air.

The above embodiment illustrates an example of the airflow rate adjusting operation in which a reduced amount of the conditioned air is blown in one or more of the plurality of blowing directions in the heating operation of the indoor unit (11), thereby increasing the blowing speed in the rest of the blowing directions. However, a similar airflow rate adjusting operation may be performed in the cooling operation, as well.

The above embodiment illustrates an example of the indoor unit (11) in which the casing (20) is provided with the load detection section (71) for detecting the high load area (Ac) and the low load area (Ah). However, the load detection section (71) may be omitted from the indoor unit of the present embodiment. If the load detection section (71) is omitted, the airflow rate adjusting operation, in which a reduced amount of the conditioned air is blown in one or more of the plurality of blowing directions to increase the blowing speed of the conditioned air in the rest of the blowing directions, is carried out by periodically changing the blowing direction in which a reduced amount of the conditioned air is blown, without taking into account the accumulated value of the flow rates of the air into the respective blowing directions.

In the above embodiment, the indoor unit (11) of the air conditioner (1) is an indoor unit installed in a ceiling and fitted in the opening of the ceiling (U). However, the indoor unit (11) may be an indoor unit hung from a ceiling, the casing (20) of which is hung from the ceiling and arranged in the room space (R). Further, the blowing directions of the indoor unit (11) are not limited to, e.g., four or eight directions, as long as the blowing directions are directed to the high load area or the low load area of the perimeter zone.

The above embodiment illustrates an example of the indoor unit which can perform the horizontal blow mode and the downward blow mode. However, the blow mode of the indoor unit is not limited to the horizontal blow mode and the downward blow mode. The indoor unit of the present embodiment may selectively perform the blow mode in which the wind direction adjusting blade (51) swings and the horizontal blow mode, or may perform only the horizontal blow mode, for example.

The above embodiment illustrates an example of the indoor unit (11) which makes the flow rate of the air into the high load area (Ac) and the flow rate of the air into the low load area (Ah) different from each other by means of the wind direction adjusting blade (51). However, the indoor unit of the present embodiment may be configured to make the flow rate of the air into the high load area (Ac) and the flow rate of the air into the low load area (Ah) different from each other by means of a configuration other than the wind direction adjusting blade (51).

The foregoing embodiments are merely preferred examples in nature, and are not intended to limit the scope, application, or uses of the invention.

INDUSTRIAL APPLICABILITY

As can be seem from the foregoing description, the present invention is useful as a technique for controlling the airflow in a heating operation of an indoor unit of an air conditioner installed in the ceiling.

DESCRIPTION OF REFERENCE CHARACTERS

R Room Space (Air-Conditioning Target Space)
U Ceiling
1 Air Conditioner
11 Indoor Unit
20 Casing
23 Intake Hole
24 First Outlet Port (Primary Outlet Port)
26 Outlet Port
70 Operation Control Section
71 Load Detection Section

The invention claimed is:

1. An indoor unit of an air conditioner, comprising:

a casing installed in a ceiling of an air-conditioning target space, the casing being provided with outlet ports capable of blowing out conditioned air in a plurality of blowing directions different from one another, wherein the indoor unit is provided with an operation controller to carry out, in a heating operation, an airflow rate adjusting operation in which an amount of the conditioned air blown in one or more of the plurality of blowing directions is reduced to a non-zero amount to increase a blowing speed in the rest of the blowing directions, to carry out the airflow rate adjusting operation, the operation controller is configured to control flow of the conditioned air such that the conditioned air is blown out in a horizontal blow mode in the blowing direction in which the blowing speed is increased by the airflow rate adjusting operation, and periodically change the blowing direction in which a reduced amount of the conditioned air is blown, the indoor unit is provided with a load detection section which detects, for each of the blowing directions, whether an area of a perimeter zone of the air-conditioning target space is a high load area having a relatively large air conditioning load or a low load area having a smaller air conditioning load than the high load area, the indoor unit is capable of carrying out a plurality of blowing patterns having different blowing directions in which a reduced amount of the conditioned air is blown and different blowing directions in which the blowing speed is increased among one another, and in the airflow rate adjusting operation, the operation controller selects two or more blowing patterns from among the plurality of blowing patterns, to be carried out by the indoor unit, in which an accumulated value of flow rates of air into the high load area in a predetermined reference time is greater than an accumulated value of flow rates of air into the low load area in the predetermined reference time, the predetermined reference time corresponding to an accumulated time for sequentially carrying the selected blowing patterns, and instructs the indoor unit to repeatedly carry out an operation in which the selected two or more blowing patterns are sequentially switched even if the detected high load and low load areas do not change.

2. The indoor unit of claim 1, wherein the indoor unit is configured to blow out the conditioned air in four different blowing directions 90° apart from each other, and the operation controller reduces, in the airflow rate adjusting operation, flow of the conditioned air in two of the four blowing directions to increase the blowing speed in the other two blowing directions.

3. The indoor unit of claim 1, wherein the outlet ports include a plurality of primary outlet ports configured to blow out the conditioned air in directions different from one another, the casing is provided with an intake hole arranged adjacent to the plurality of primary outlet ports and configured to draw in room air, and the operation controller controls the flow of the conditioned air blown out from the primary outlet port corresponding to the blowing direction in which a reduced amount of the conditioned air is blown in the airflow rate adjusting operation, such that the conditioned air is blown out toward the intake hole and drawn into the intake hole.

4. The indoor unit of claim 2, wherein the two blowing directions in which a reduced amount of the conditioned air is blown are 180° apart from each other.

5. The indoor unit of claim 2, wherein the outlet ports include a plurality of primary outlet ports configured to blow out the conditioned air in directions different from one another, the casing is provided with an intake hole arranged adjacent to the plurality of primary outlet ports and configured to draw in room air, and the operation controller controls the flow of the conditioned air blown out from the primary outlet port corresponding to the blowing direction in which a reduced amount of the conditioned air is blown in the airflow rate adjusting operation, such that the conditioned air is blown out toward the intake hole and drawn into the intake hole.

* * * * *